US009601840B2

(12) United States Patent
Tonoike et al.

(10) Patent No.: US 9,601,840 B2
(45) Date of Patent: Mar. 21, 2017

(54) TERMINAL CONNECTION STRIP, METHOD OF MANUFACTURING CRIMP TERMINAL, WIRE CRIMPING DEVICE, AND METHOD OF CRIMPING WIRE

(71) Applicants: FURUKAWA ELECTRIC CO., LTD., Tokyo (JP); FURUKAWA AUTOMOTIVE SYSTEMS, INC., Shiga (JP)

(72) Inventors: Takashi Tonoike, Shiga (JP); Yukihiro Kawamura, Shiga (JP); Saburo Yagi, Tokyo (JP); Satoshi Takamura, Shiga (JP); Takeshi Hyotani, Shiga (JP); Koichi Kitagawa, Shiga (JP); Eiji Aramaki, Shiga (JP)

(73) Assignees: FURUKAWA ELECTRIC CO., LTD., Tokyo (JP); FURUKAWA AUTOMOTIVE SYSTEMS, INC., Shiga (JP)

( * ) Notice: Subject to any disclaimer, the term of this patent is extended or adjusted under 35 U.S.C. 154(b) by 0 days.

(21) Appl. No.: 14/832,894

(22) Filed: Aug. 21, 2015

(65) Prior Publication Data

US 2015/0364838 A1 Dec. 17, 2015

Related U.S. Application Data

(63) Continuation of application No. PCT/JP2013/084406, filed on Dec. 24, 2013.

(30) Foreign Application Priority Data

Feb. 22, 2013 (JP) ..... 2013-032843
Feb. 23, 2013 (JP) ..... 2013-033970
May 22, 2013 (JP) ..... 2013-107737

(51) Int. Cl.
*H01R 43/16* (2006.01)
*H01R 43/048* (2006.01)
(Continued)

(52) U.S. Cl.
CPC ..... *H01R 4/187* (2013.01); *H01R 4/183* (2013.01); *H01R 4/20* (2013.01); *H01R 43/02* (2013.01);
(Continued)

(58) Field of Classification Search
CPC ... H01R 43/16; H01R 43/0221; H01R 43/048
(Continued)

(56) References Cited

U.S. PATENT DOCUMENTS 3,516,157 A * 6/1970 Brown ..... H01R 43/205 156/553
3,795,889 A * 3/1974 Nauman ..... H01R 13/424 206/717
(Continued)

FOREIGN PATENT DOCUMENTS

JP Y H2-35196 9/1990
JP 3-81083 A 4/1991
(Continued)

OTHER PUBLICATIONS

Office Action issued Mar. 26, 2014 to Japanese patent application No. 2014-506650, with English translation.
(Continued)

*Primary Examiner* — Gary Paumen
(74) *Attorney, Agent, or Firm* — Oblon, McClelland, Maier & Neustadt, L.L.P.

(57) ABSTRACT

The terminal connection strip includes: a carrier formed in a strip shape; and a plurality of terminal fitting which project from at least one edge side of the carrier in a width direction. The terminal fitting includes a crimping section which
(Continued)

connects by crimping at least a conductor tip of an insulated wire provided with the conductor tip where a conductor is covered with an insulating cover and the conductor is exposed by peeling off the insulating cover on a distal end side of the insulated wire to the terminal fitting. The crimping section is formed into a hollow shape which allows the insertion of at least the conductor tip from a proximal end side of the crimping section and allows the crimping section to surround the conductor tip.

7 Claims, 23 Drawing Sheets

(51) Int. Cl.
*H01R 4/18* (2006.01)
*H01R 4/20* (2006.01)
*H01R 43/02* (2006.01)
*H01R 43/05* (2006.01)

(52) U.S. Cl.
CPC ..... *H01R 43/048* (2013.01); *H01R 43/05* (2013.01); *H01R 43/16* (2013.01); *Y10T 29/4922* (2015.01); *Y10T 29/49215* (2015.01); *Y10T 29/53235* (2015.01)

(58) Field of Classification Search
USPC ..... 439/885; 29/564.6, 566.2, 739, 842
See application file for complete search history.

(56) References Cited

U.S. PATENT DOCUMENTS 3,857,995 A * 12/1974 Wyrick ..... H01R 4/188 174/84 C
4,466,689 A * 8/1984 Davis ..... H01R 43/16 206/717
5,340,337 A * 8/1994 Pentz ..... H01R 13/18 439/843
8,083,554 B2 * 12/2011 McAlonis ..... H01R 12/585 439/733.1
8,640,333 B2 * 2/2014 Lyford ..... H01R 43/048 29/566.2
2005/0109501 A1 * 5/2005 Ludwig ..... E21B 43/119 166/55
2011/0124249 A1 * 5/2011 Kanda ..... H01R 24/44 439/885
2012/0135648 A1 * 5/2012 Morikawa ..... H01R 43/16 439/885
2013/0059485 A1 * 3/2013 Oh ..... H01R 13/04 439/852
2014/0273667 A1 * 9/2014 Tachibana ..... H01R 43/048 439/877
2015/0357725 A1 * 12/2015 Matsuo ..... C22C 9/00 439/877

FOREIGN PATENT DOCUMENTS

JP 3-81983 A 4/1991
JP U H7-27086 5/1995
JP 10-328862 A 12/1998
JP 2002-343529 A 11/2002
JP 2004-71437 A 3/2004
JP 2008-234925 A 10/2008
JP 2011-34772 A 2/2011

OTHER PUBLICATIONS

Office Action issued May 14, 2014 to Japanese patent application No. 2014-506650, with English translation.
Decision to Grant a Patent issued Jun. 17, 2014 to Japanese patent application No. 2014-506650, with English translation.
Decision to Grant a Patent Issued Jun. 27, 2014 to Japanese patent application No. 2014-103447, with English translation.
International Search Report issued Apr. 8, 2014 to International Patent Application No. PCT/JP2013/084406, with English translation, filed Dec. 24, 2013.

* cited by examiner

FIG. 5A1
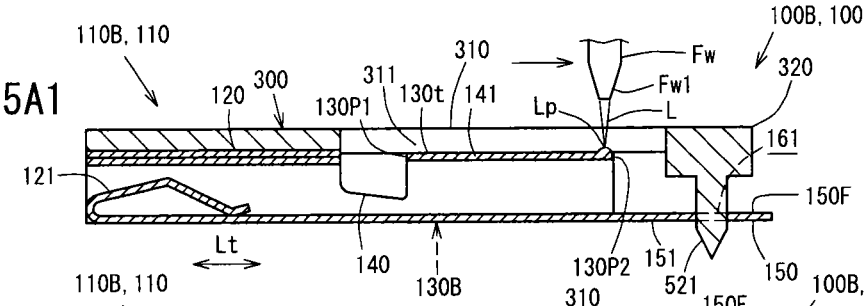
FIG. 5A2
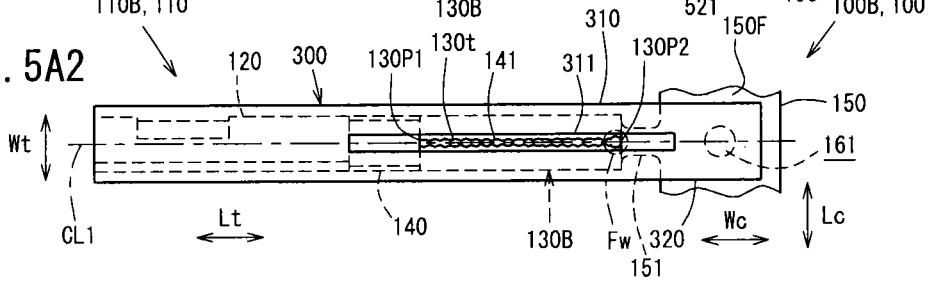
FIG. 5B1
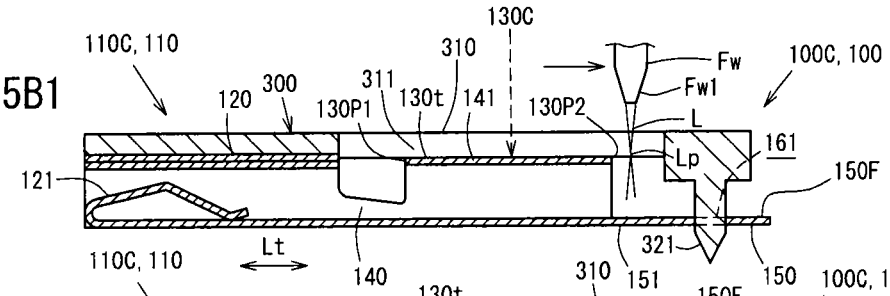
FIG. 5B2
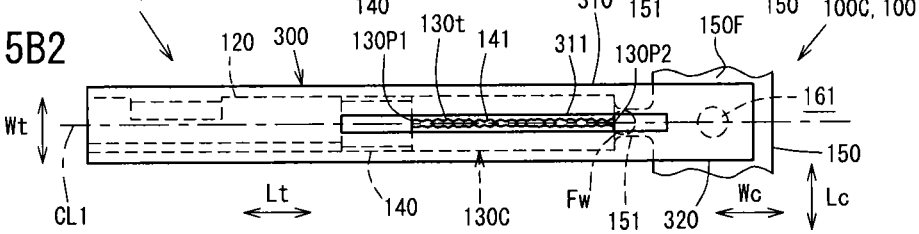

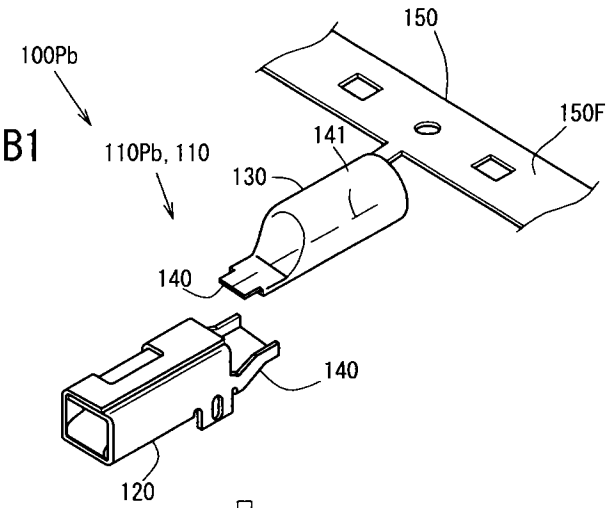
FIG. 8B1
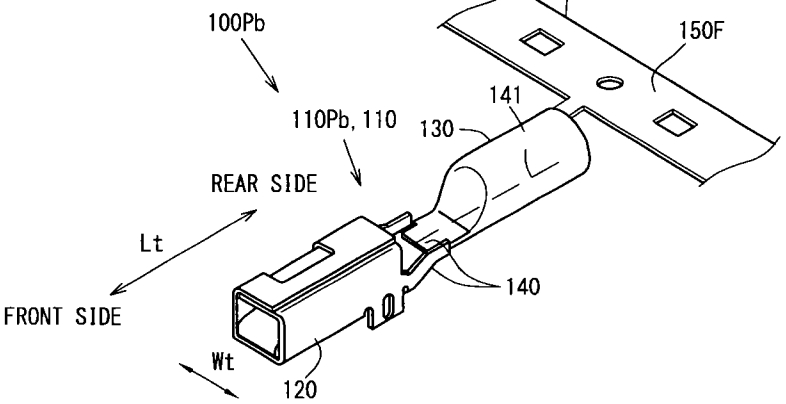
FIG. 8B2
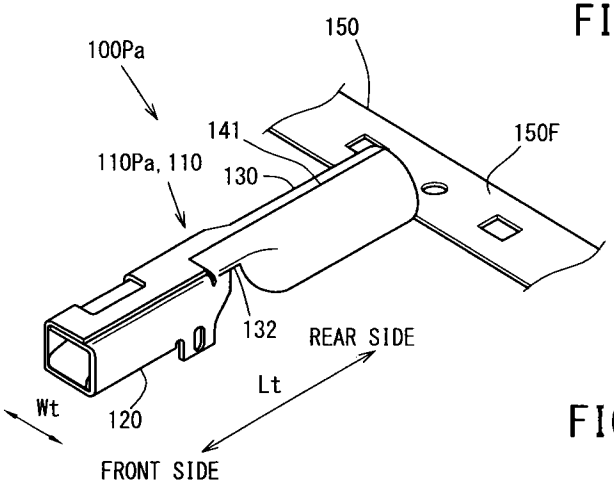
FIG. 8A

FIG. 17A
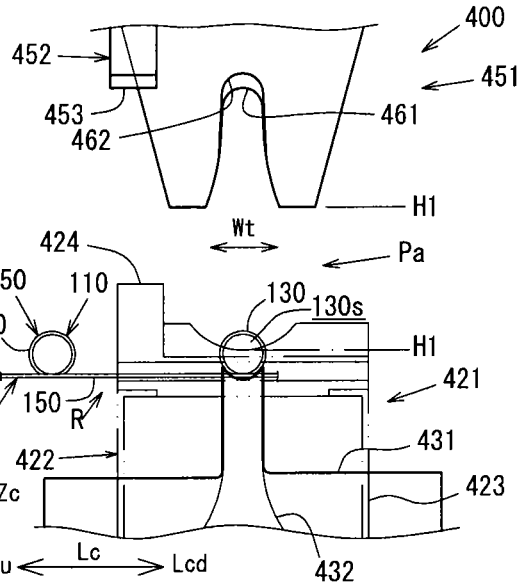
FIG. 17B
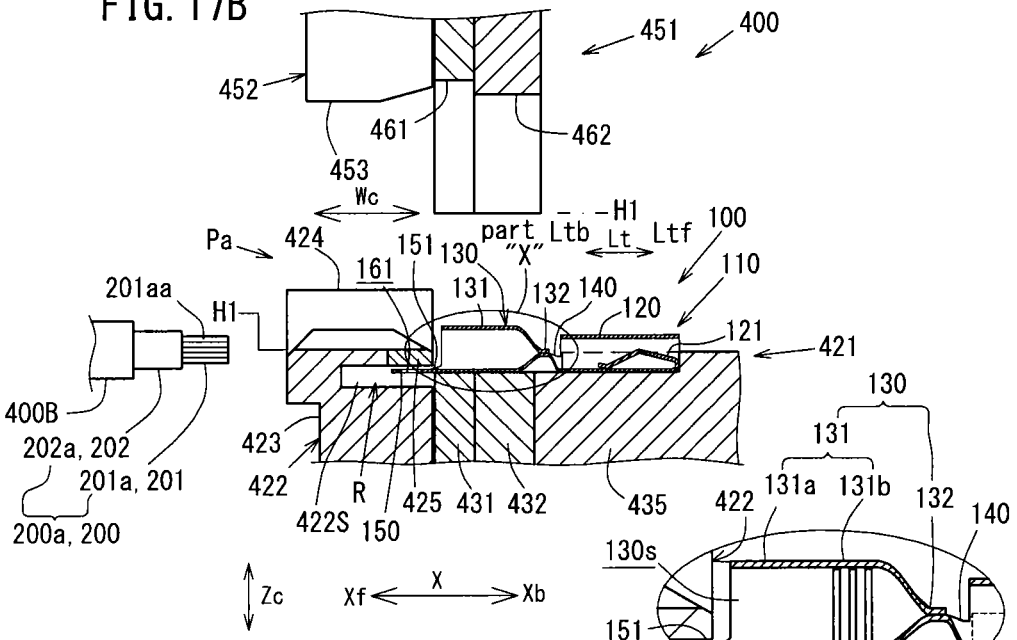
FIG. 17C

FIG. 22A1
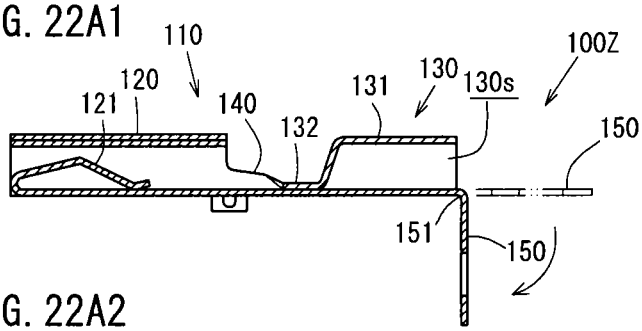
FIG. 22A2
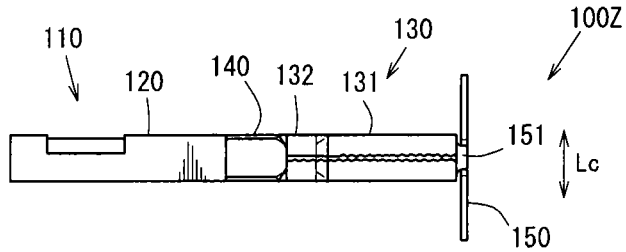
FIG. 22B1
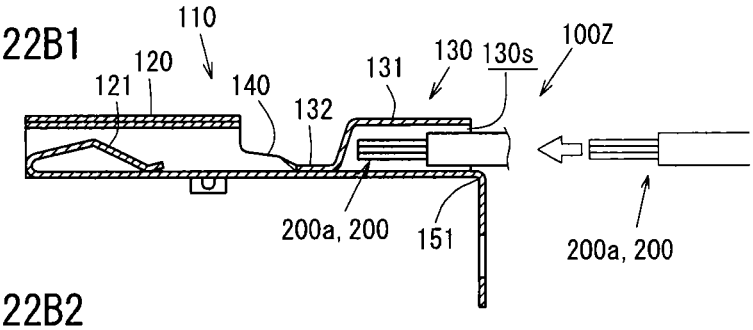
FIG. 22B2
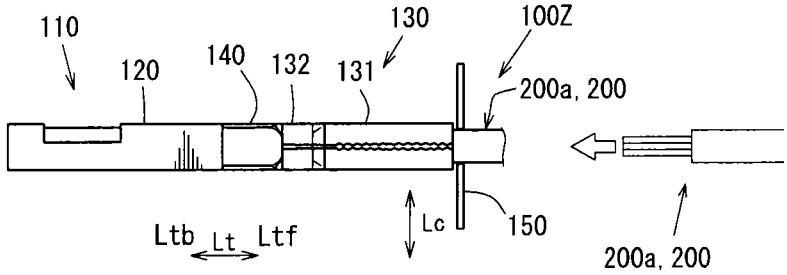

TERMINAL CONNECTION STRIP, METHOD OF MANUFACTURING CRIMP TERMINAL, WIRE CRIMPING DEVICE, AND METHOD OF CRIMPING WIRE

TECHNICAL FIELD

The present invention relates to a terminal connection strip which is used in manufacturing a crimp terminal mounted on a connector of an automobile-use wire harness or the like, for example, and is constituted of a carrier formed in a strip shape and a plurality of terminal fittings projecting from at least one end side of the carrier in the width direction by way of press working of a base material. The present invention also relates to a method of manufacturing a crimp terminal which is manufactured using the terminal connection strip. The present invention also relates to a wire crimping device and a wire crimping method where a crimp terminal of a terminal connection strip which is constituted of a carrier formed in a strip shape and a plurality of crimp terminals projecting from at least one end side of the carrier in the width direction is connected by crimping to a conductor tip formed by exposing a conductor by peeling off an insulating cover on a distal end side of an insulated wire.

BACKGROUND ART

An electric device on an automobile or the like is connected with other electric devices and a power source device via a wire harness formed by binding insulated wires thus constituting an electric circuit. In such a constitution, the wire harness is connected with the electric devices and the power source device by connecting connectors which are mounted on these components to each other.

With respect to these connectors, a crimp terminal which is connected to the insulated wire by crimping is incorporated in the inside of the connector. A female connector and a male connector which are connected to each other in the concave and convex relationship are configured to be engaged with each other by fitting engagement. Such connectors are used in many connection places where the wire harness is connected with the electric device and the power source device. Accordingly, a large number of crimp terminals are used in various places in the vehicle.

Such connectors are used under various environments and hence, there may be a case where unintended moisture adheres to a surface of the insulated wire due to condensation brought about by a change in ambient temperature or the like. There is a drawback that, when moisture intrudes into the inside of the connector along the surface of the insulated wire, a surface of a wire conductor exposed from a distal end of the insulated wire corrodes.

In view of the above, with respect to a crimp terminal, to prevent moisture from intruding into the inside of a crimping section which crimps a wire conductor, unlike an open-barrel-type crimp terminal where wire conductor inserted into a crimping section is not surrounded by the crimping section over the whole circumference, there has been proposed a closed-barrel-type crimp terminal provided with a cylindrical crimping section which crimps a wire conductor inserted into the inside of the crimping section in the form that the wire conductor is surrounded over the whole circumference.

Such a closed-barrel-type crimp terminal has been individually manufactured by molding, brazing or the like. In connecting the crimping section to the wire conductor by crimping, such connection is performed using continuous crimp terminals described in Patent Document 1, for example.

This will be described in more detail. The continuous crimp terminals are a resin-made integral body formed of cylindrical sleeves which individually hold crimp terminals in fitting engagement, and a connection belt which connects these sleeves to each other.

In connecting the crimping sections to the wire conductors by crimping using such continuous crimp terminals, the connection belt is fed to dies of an automatic crimping machine for respective sleeves in a state where the crimping sections of the respective crimp terminals are held in the sleeves by fitting engagement, and the crimping section and the wire inserted into the crimping section are connected to each other by crimping one by one by the dies for respective sleeves.

However, as described above, in the conventional method of manufacturing a closed-barrel-type crimp terminal, the closed-barrel-type crimp terminal is manufactured by molding one by one and hence, also at the time of crimping the wire, it is necessary to hold the crimping section of the closed-barrel-type crimp terminal in the sleeve of the continuous crimp terminals by fitting engagement individually. Accordingly, the manufacturing efficiency of a closed-barrel-type crimp terminal provided with a hollow crimping section is remarkably low.

On the other hand, in a case of the open-barrel-type crimp terminal, for example, a crimping section is crimped to an insulated wire using a device such as a terminal crimping device disclosed in Patent Document 2.

To be more specific, a terminal connection strip which is formed as an integral body consisting of a carrier having a strip shape and a plurality of crimp terminals which are provided to at least one edge side of the carrier in the width direction by way of connecting portions in a chained manner is paid off from a reel, is intermittently fed to a terminal crimping device and, at the same time, an insulated wire is arranged in the inside of the crimp terminal. Thereafter, a crimping section is caulked by anvils (6, 7) and crimpers (14, 15) so that the crimping section is crimped to a conductor thus connecting the crimp terminal to an insulated wire. At the same time, the crimp terminal and the carrier are separated from each other by a slide cutter (5) and hence, wire connection structural body can be continuously manufactured on a mass production basis.

On the other hand, in a case of the closed-barrel-type crimp terminal, to arrange the insulated wire in the crimping section of the crimp terminal, it is necessary to insert a conductor tip of the insulated wire through an insertion opening formed on a proximal end side of the crimping section. However, in inserting the conductor tip into the inside of the crimping section, the conductor tip and the slide cutter (5) which is arranged so as to sandwich the carrier interfere with each other thus giving rise to a drawback that the conductor tip cannot be inserted into the inside of the crimping section.

Accordingly, in the case of the closed-barrel-type crimp terminal, it is impossible to manufacture the wire connection structural body by sequentially connecting the crimp terminal to the insulated wire while sequentially conveying the terminal connection strip having a strip shape and hence, there is no other way but to manufacture the wire connection structural body individually using a method such as brazing or casting thus giving rise to a drawback that the wire connection structural body cannot be efficiently manufactured.

PRIOR ART DOCUMENTS

Patent Documents

Patent Document 1: Japanese Utility-Model Publication No. 2-35196

Patent Document 2: Japanese Unexamined Utility-Model Publication No. 7-27086

SUMMARY OF THE INVENTION

Problems to be Solved by the Invention

The present invention has been made in view of the above-mentioned drawbacks, and it is an object of the present invention to provide a terminal connection strip and a method of manufacturing a crimp terminal by which a crimp terminal provided with a hollow crimping section having high quality and excellent water-blocking performance and excellent conductivity can be efficiently manufactured, and a wire crimping device and wire crimping method which can surely and efficiently crimp a hollow crimping section of a closed-barrel-type crimp terminal and a conductor tip inserted into the crimping section.

Solution to the Problems

The present invention is directed to a terminal connection strip which includes: a carrier formed in a strip shape; and a plurality of terminal fittings which project from at least one edge side of the carrier in a width direction, wherein each of the terminal fittings includes a crimping section which connects by crimping at least a conductor tip of an insulated wire provided with the conductor tip where a conductor is exposed by peeling off an insulating cover on a distal end side of the insulated wire to the terminal fitting, wherein the crimping section is formed into a hollow shape which allows the insertion of at least the conductor tip from a proximal end side of the crimping section and allows the crimping section to surround the conductor tip, the proximal end side of the crimping section and the carrier are connected to each other by way of a connection portion and have bottom surfaces thereof formed in common, the crimping section is formed such that a crimping base material which corresponds to the crimping section of the terminal fitting is bent around an axis of the terminal fitting, and a welded portion which is formed by welding opposedly-facing edge portions which face each other in an opposed manner is formed along a terminal long length direction, and at least a proximal end side of the welded portion in the terminal long length direction is formed at a place which is not disposed on the same plane as a carrier surface of the carrier in a circumferential direction of the crimping section.

Due to the above-mentioned constitution, the terminal connection strip is configured such that the plurality of terminal fittings each provided with a hollow crimping section are connected to the carrier and hence, the terminal fittings are configured to be intermittently fed along the long length direction of the carrier. Accordingly, high-quality crimp terminals each provided with the hollow crimping section can be efficiently manufactured.

The conductor may be formed of a stranded wire formed by stranding raw wires or may be formed of a single wire. Further, the conductor may be made of the same metal as a crimp terminal which is made of a copper alloy, for example. Further, the conductor may be made of a dissimilar metal such as aluminum or an aluminum alloy which is a less noble metal with respect to a metal for forming the crimp terminal.

Moreover, the proximal end side of the crimping section and the carrier are connected to each other by way of a connection portion and have bottom surfaces thereof formed in common, the crimping section is formed such that a crimping base material which corresponds to the crimping section of the terminal fitting is bent around an axis of the terminal fitting, and a welded portion which is formed by welding opposedly-facing edge portions which face each other in an opposed manner is formed along a terminal long length direction, and at least a proximal end side of the welded portion in the terminal long length direction is formed at a place which is not disposed on the same plane as a carrier surface of the carrier in a circumferential direction of the crimping section, so that, a high-quality crimp terminal provided with a hollow crimping section can be manufactured efficiently and, at the same time, the crimping section can be crimped to the conductor tip in a crimped state with excellent water-blocking performance.

The welding of the opposedly-facing edge portions of the crimping base material to each other is described in detail hereinafter by assuming, for example, a case where the welding is performed using a heat imparting means (energy generating means) which imparts heat to the opposedly-facing edge portions such as a laser welding means.

In moving the heat imparting means along a long length direction of the crimping section so as to weld the opposedly-facing edge portions of the crimping base material, the heat imparting means may move on the carrier surface after passing the proximal end side of the crimping section. Even in such a case, by forming at least the proximal end side of the welded portion in the terminal long length direction at the place which is not disposed on the same plane as the carrier surface of the carrier, a damage which is given to a connection portion that connects the terminal fitting, the carrier or the like can be decreased. Further, there is no possibility that the connection portion that connects the terminal fitting is melted or cut and hence, it is possible to ensure the reliability of a connection state of the terminal connection strip where the crimping section and the carrier are connected with each other.

Accordingly, the opposedly-facing edge portions can be surely welded to each other without forming a gap up to the proximal end side of the crimping section in the long length direction and hence, the crimping section can be accurately formed into a hollow shape whereby a high-quality crimp terminal provided with a hollow crimping section having excellent water-blocking performance can be formed.

Further, in the terminal connection strip where the plurality of terminal fittings are connected to the strip-shaped carrier, the crimping section of the terminal fitting can be welded in a hollow shape and hence, high-quality crimp terminals can be efficiently manufactured on a mass-production basis.

As one mode of the present invention, at least the proximal end side of the welded portion in the terminal long length direction is formed at the place which is not disposed on the same plane as the carrier surface of the carrier in the circumferential direction of the crimping section, and the welded portion is arranged to be away upward from the carrier surface by an amount corresponding to a height of the crimping section.

the connection portion is formed with a width which is 1/16 or more and 1/4 or less of an outer peripheral length of the crimping section.

As one mode of the present invention, the terminal connection strip may be configured such that a positioning hole which allows the insertion of a positioning pin which positions the carrier is arranged for every connection portion which connects the terminal fitting to the carrier in the long length direction.

With the use of the above-mentioned positioning hole, by sliding the positioning pin along the long length direction of the carrier in a state where the positioning pin is inserted into the positioning hole, the carrier can be fed at fixed intervals (predetermined pitches).

Further, for welding the opposedly-facing edge portions which is obtained by bending the crimping base material around the axis of the terminal fitting to face each other in an opposed manner, at the time of imparting heat to the opposedly-facing edge portions by the heat imparting means along the long length direction of the crimping section, using the hole center, for example, of the positioning hole positioned on the extension of the opposedly-facing edge portions as a target, it is possible to make the heat imparting means accurately travel along the opposedly-facing edge portions such that the heat imparting means is not positionally displaced with respect to the opposedly-facing edge portions.

Accordingly, a high-quality crimp terminal provided with a hollow crimping section having no gap at the opposedly-facing edge portions can be formed and, at the same time, the opposedly-facing edge portions of the hollow crimping section can be accurately and easily welded to each other and hence, crimp terminals can be manufactured efficiently on a mass production basis.

The positioning hole may be formed into a circular shape as viewed from the front side such as a perfect circle or an elliptical circle. Further, the positioning hole may be formed into an elongated shape, a polygonal shape, a tongue shape or a so-called home-base shape where a quadrangular shape and a triangular shape have made respective predetermined one sides thereof agree with each other.

As a target to be a terminal point of a trajectory along which a laser emitting part Fw1 moves at the time of applying welding to the crimping section, a notch may be formed at an edge portion of the positioning hole, an arrow or the like may be printed on the edge portion of the positioning hole, or a recessed portion or a projecting portion may be formed on the edge portion of the positioning hole.

As one mode of the present invention, the terminal connection strip may be configured such that, out of the positioning hole provided in plural, a positioning hole for every predetermined number of terminal fittings is formed into a hole shape different from a hole shape of other positioning holes.

Due to the above-mentioned constitution, by changing shapes of the positioning holes having different hole shapes corresponding to the number of lots (pitch) at which the terminal fittings connected to the carrier are fed, at a unit of lots at which the terminal fittings are fed, the plurality of terminal fittings included in the lot can be easily identified. Accordingly, for example, the terminal fitting having a defect can be accurately and readily identified.

Effects of the Invention

The present invention can provide a terminal connection strip and a method of manufacturing a crimp terminal by which a crimp terminal provided with a hollow crimping section having high quality and excellent water-blocking performance and excellent conductivity can be efficiently manufactured, and a wire crimping device and wire crimping method which can surely and efficiently crimp a hollow a crimping section of a closed-barrel-type crimp terminal and a conductor tip inserted into the crimping section.

BRIEF DESCRIPTION OF THE DRAWINGS

FIG. 5A1 to FIG. 5B2 are operational explanatory views of the welding step.

FIG. 8A to FIG. 8B2 are constitutional explanatory views of another terminal connection strip according to the first embodiment.

FIG. 17A to FIG. 17C are constitutional explanatory views with a part shown in an enlarged manner of the wire crimping device.

FIG. 22A1 to FIG. 22B2 are explanatory views of the other wire crimping method of the second embodiment.

EMBODIMENTS OF THE INVENTION

Embodiments of the present invention are described hereafter by reference to the drawings.

(First Embodiment)

Figure 1A:
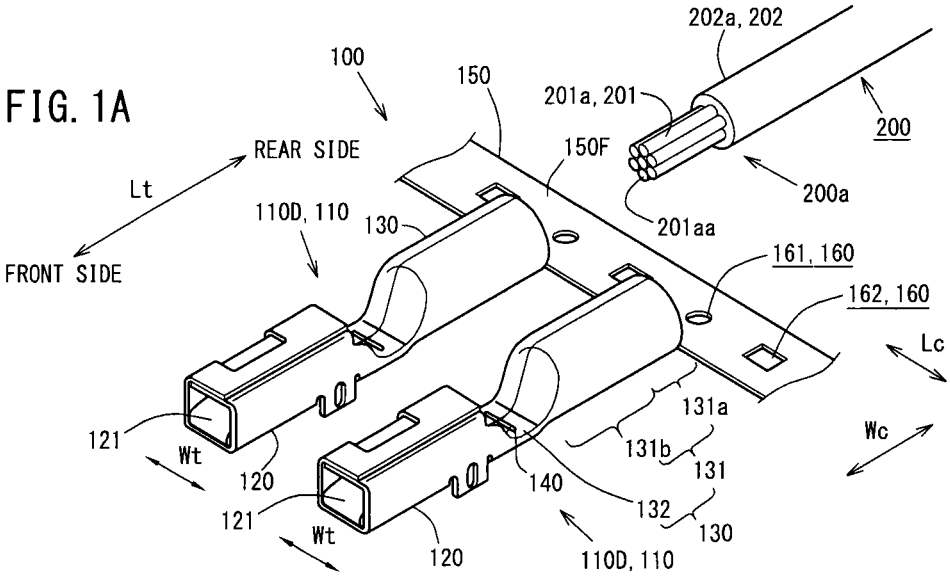
FIG. 1A and FIG. 1B are constitutional explanatory views of a terminal connection strip according to a first embodiment.
Figure 1B:
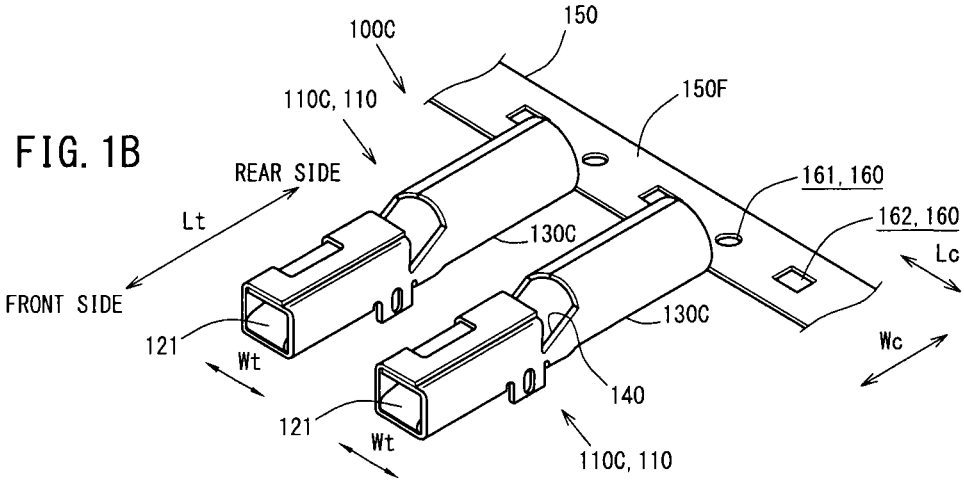

FIG. 1A is a perspective view of a terminal connection strip 100 according to this embodiment. This will be described in more detail. FIG. 1A shows a state immediately before a wire tip 200*a* is inserted into a crimping section 130 of a female crimp terminal 110. FIG. 1B is a perspective view showing a state immediately after a welding step, and is a perspective view of a terminal connection strip 100C before a sealing portion forming step.

In this embodiment, as shown in FIG. 1A, the terminal connection strip 100C is formed of an integral body constituted of a carrier 150 formed into a strip shape, and a plurality of female terminal fittings 110D which project from at least one edge side of the carrier 150 in a carrier width direction Wc.

The terminal fitting 110D can be separated from the carrier 150 as a closed-barrel-type female crimp terminal 110 by cutting a connection portion 151 that connects the carrier 150. Further, a wire provided with a crimp terminal (not shown in the drawing) can be formed by connecting by crimping an insulated wire 200 to the crimping section 130 of the female crimp terminal 110 described later.

The insulated wire 200 which is connected to the female crimp terminal 110 by crimping is formed by covering a conductor 201 which is an aluminum core wire formed by binding aluminum raw wires 210*aa* made of aluminum or an aluminum alloy with an insulating cover 202 made of an insulating resin. This will be described in more detail. The conductor 201 is formed by stranding aluminum alloy wires such that the conductor 201 has a cross-sectional area of 0.75 $mm^2$.

The conductor 201 of the insulated wire 200 is not limited to the conductor 201 formed of the aluminum core wire which is formed by binding the aluminum raw wires 201*aa*, and may be a copper-based conductor formed of a core wire which is formed by binding copper-based raw wires made of copper or a copper alloy. Further, the conductor 201 may be a dissimilar metal mixed conductor formed of a stranded core wire where copper-based raw wires are arranged around aluminum raw wires 201*aa*. The conductor 201 may be a dissimilar metal mixed conductor formed of a bound core wire having the opposite structure where aluminum raw wires 201*aa* are arranged around copper-based raw wires.

A wire tip 200*a* arranged on a distal end side of the insulated wire 200 is inserted into the crimping section 130.

The wire tip 200*a* is a portion at a distal end portion of the insulated wire 200 where a cover tip 202*a* and a conductor tip 201*a* are arranged in series in this order toward the distal end side of the insulated wire 200.

The conductor tip 201*a* is a portion where the conductor 201 is exposed by peeling off the insulating cover 202 on a front side of the insulated wire 200. Although the cover tip 202*a* is also a distal end portion of the insulated wire 200, the cover tip 202*a* is a portion arranged behind the conductor tip 201*a* where the conductor 201 is covered with the insulating cover 202.

The carrier 150 is formed into a strip shape, and a plurality of terminal fittings 110D are provided to the carrier 150 at fixed intervals (predetermined pitches) in a carrier long length direction Lc.

The terminal fittings 110D project from one edge side of the carrier 150 in a carrier width direction Wc toward the outside in the carrier width direction Wc by way of connection portions 151 (see FIG. 1A).

Positioning holes 160 are formed in the carrier 150. The positioning hole 160 allows the insertion of a positioning pin of a carrier feeding mechanism not shown in the drawing for positioning the carrier 150 while feeding the carrier 150 along one side of the carrier long length direction Lc at the time of manufacturing the female crimp terminals 110.

The positioning holes 160 are formed of two kinds of holes, that is, first positioning holes 161 and second positioning holes 162 in accordance with the difference in pitches. Both holes are formed in the carrier 150 along a center axis portion in the carrier width direction Wc.

A plurality of first positioning holes 161 and a plurality of second positioning holes 162 are formed in the carrier 150 along the carrier long length direction Lc with different shapes.

The first positioning hole 161 is arranged in the carrier 150 for every connection portion 151 that connects the terminal fitting 110D in the carrier long length direction Lc, and the plurality of respective first positioning holes 161 are formed into a perfect circle hole shape in a plan view. This will be described in more detail. The first positioning hole 161 having a perfect circle shape is formed such that a center portion 161*a* (see FIG. 2) is disposed at an intersecting point between a center axis CL2 in the carrier width direction We and an extension of a terminal center axis CL1 in the terminal width direction Wt.

Figure 2:
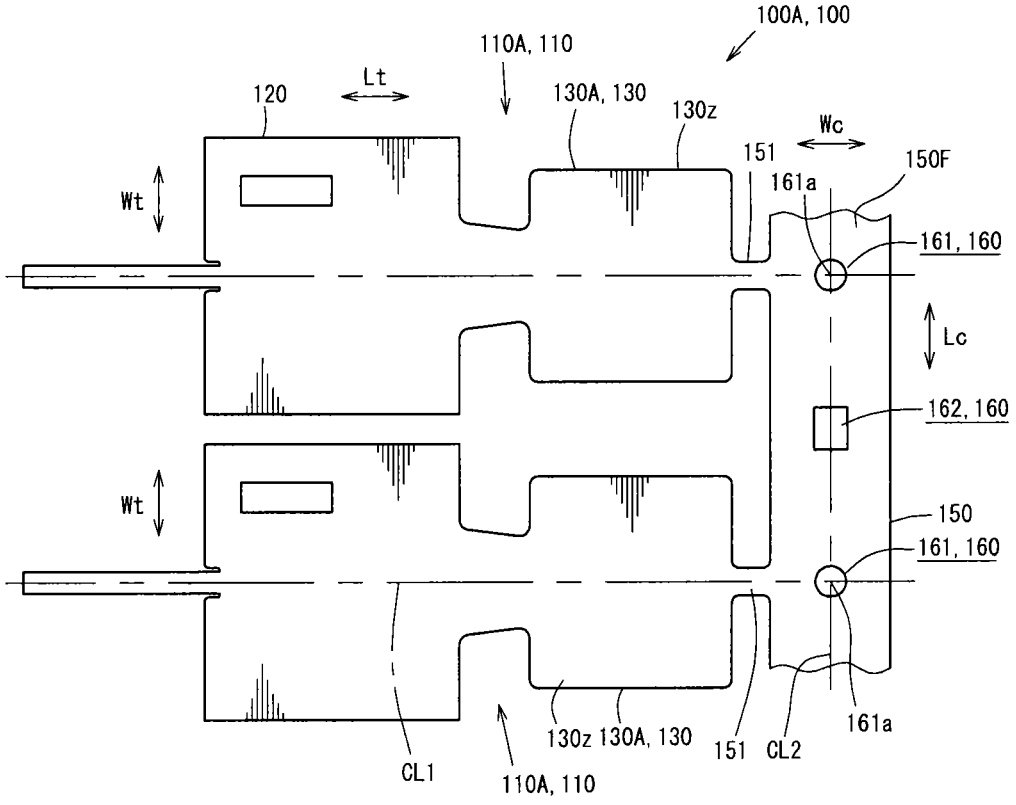
FIG. 2 is a plan view of the terminal connection strip during manufacturing steps.

This will be described in more detail. As shown in FIG. 5A2, the first positioning hole 161 is arranged along the carrier long length direction Lc of the carrier 150 such that the center portion 161*a* of the first positioning hole 161 is positioned on an extension of opposedly-facing edge portions 130*t* which face each other in an opposed manner by bending a crimping base material 130B for forming the crimping section 130 of the terminal fitting 110D about an axis of the terminal fitting 110D, that is, on the center axis CL1 in the terminal width direction Wt.

On the other hand, as shown in FIG. 1A, FIG. 1B and FIG. 2, the second positioning holes 162 are formed into a quadrangular hole shape in a plan view. The second positioning holes 162 are arranged in the carrier 150 at predetermined pitches in the carrier long length direction Lc such that each second positioning hole 162 is positioned between the connection portions 151 that connect the terminal fittings 110D.

The connection portion 151 connects the crimping section 130 of the terminal fitting 110D and the carrier 150 to each other. It is desirable that a width of the connection portion 151 is 1/16 or more and 1/4 or less of an outer peripheral length of the crimping section 130.

By setting the width of the connection portion 151 to 1/16 or more of the outer peripheral length of the crimping section 130, the connection portion 151 can maintain strength for holding the terminal fitting 110D and the carrier 150 in a connection state.

On the other hand, by setting the width of the connection portion 151 to 1/4 or less of the outer peripheral length of the crimping section 130, at the time of cutting the connection portion 151, it is possible to prevent the crimping section 130 from being distorted or the generation of burrs at a cut portion along with the cutting of the connection portion 151.

Subsequently, the above-mentioned female crimp terminal 110 is described in detail.

The female crimp terminal 110 is formed of an integral body constituted of; a box section 120 which extends from a front side which is a distal end side in the terminal long length direction Lt to a rear side and allows the insertion of an insertion tab of a male crimp terminal not shown in the drawing; and the crimping section 130 which is arranged behind the box section 120 by way of a transition section 140 having a predetermined length.

In this embodiment, as described above, the crimp terminal is formed of the female crimp terminal 110 which is constituted of the box section 120 and the crimping section 130. However, provided that the crimp terminal is a crimp terminal provided with the crimping section 130, the crimp terminal may be a male crimp terminal which is constituted of an inserting tab not shown in the drawing which is inserted into and connected to the box section 120 of the above-mentioned female crimp terminal 110 and a crimping section 130, or the crimp terminal may be a crimp terminal which is constituted of only a crimping section 130 and performs connection by binding conductors 201 of a plurality of insulated wires 200.

Here, the terminal long length direction Lt is, as shown in FIG. 1A, the direction which agrees with a long length direction of the insulated wire 200 which is connected to the female crimp terminal 110 by crimping the crimping section 130 and the carrier width direction Wc. The terminal width direction Wt corresponds to a width direction of the female crimp terminal 110, and is the direction which intersects with the terminal long length direction Lt in the planar direction. The terminal width direction Wt is also the direction which agrees with the carrier long length direction Lc. A side where the box section 120 is arranged with respect to the crimping section 130 is set as a front side (distal end side), and a side where the crimping section 130 is arranged with respect to the box section 120 is set as a rear side (proximal end side) reversely.

The box section 120 is formed into a hollow quadratic prism body in a laid-down state. A resilient contact lug 121 bent backward in the terminal long length direction Lt is formed in the inside of the box section 120. The resilient contact lug 121 is brought into contact with an inserting tab (not shown in the drawing) of an inserted male-type connector.

The box section 120 having the hollow quadratic prism body shape is formed into an approximately rectangular shape as viewed from a distal end side in the terminal long length direction Lt by bending and overlapping side surface portions which are contiguously formed at both side portions of a bottom surface portion in the terminal width direction Wt orthogonal to the terminal long length direction Lt.

The crimping section 130 is formed of a continuous integral body consisting of the wire crimping section 131 and the sealing portion 132 which are arranged toward a front side from a rear side and are continuously formed over the whole circumference (see FIG. 1A).

The sealing portion 132 is formed into a flat plate shape such that predetermined portions of the plate-shaped terminal fitting 110A (terminal base material) which forms the female crimp terminal 110 overlap with each other in the circumferential direction by depressing an end portion of the crimping section 130 in front of the wire crimping section 131 into an approximately flat plate shape.

The wire crimping section 131 is formed by continuously arranging the cover crimping section 131*a* and the conductor crimping section 131*b* in series toward a front side from a rear side in this order.

The wire crimping section 131 is formed into a hollow shape (cylindrical shape) where only a rear side is opened so as to allow the insertion of the wire tip 200*a* into the wire crimping section 131, and a front end side and the whole circumferential portion are not opened.

The cover crimping section 131*a* is a portion which corresponds to the cover tip 202*a* in the terminal long length direction Lt of the wire crimping section 131 in a state where the wire tip 200*a* is inserted into the wire crimping section 131, and is formed into a hollow shape so as to surround the cover tip 202*a*.

The conductor crimping section 131*b* is a portion which corresponds to a conductor tip 201*a* in the terminal long length direction Lt of the wire crimping section 131 in a state where the wire tip 200*a* is inserted into the wire crimping section 131, and is formed in a hollow shape so as to surround the conductor tip 201*a*.

In a pre-crimping state, the cover crimping section 131*a* and the conductor crimping section 131*b* are formed into a cylindrical shape having the substantially same inner diameter, and the inner diameters are approximately equal to an outer diameter of the cover tip 202*a* or are slightly larger than an outer diameter of the cover tip 202*a*.

Subsequently, a manufacturing method for manufacturing the above-mentioned female crimp terminal 110 using the terminal connection strip 100 is described by reference to FIG. 2 to FIG. 5B2.

Figure 3:
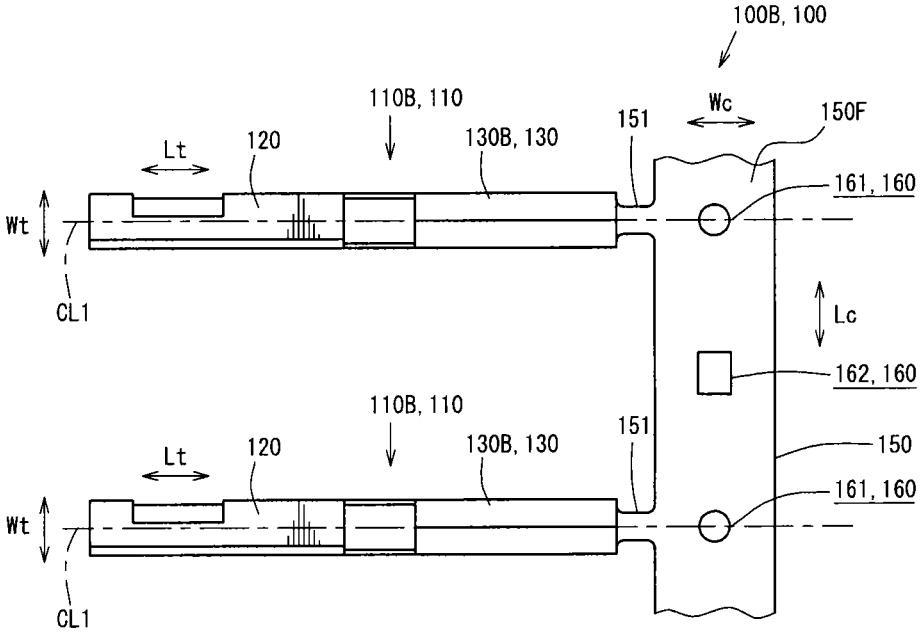
FIG. 3 is a plan view of the terminal connection strip during manufacturing steps.
Figure 4A:
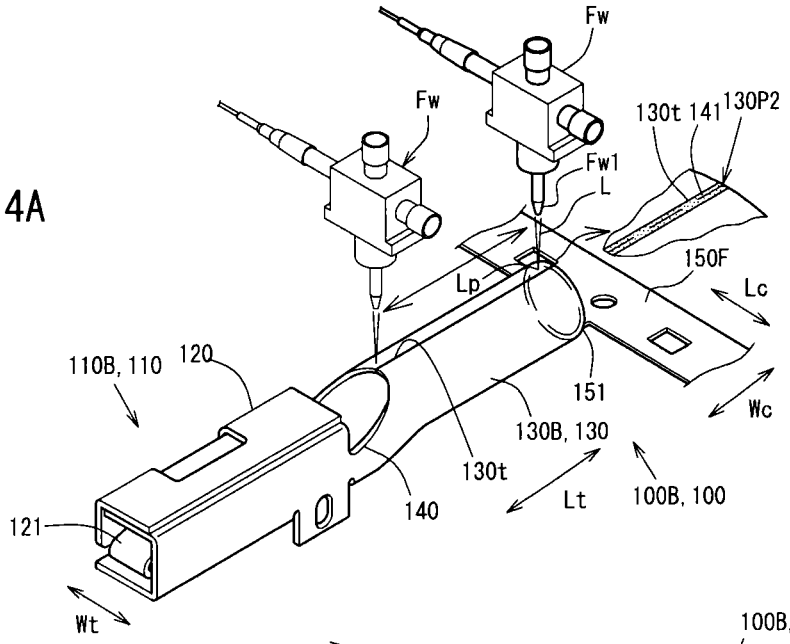
FIG. 4A to FIG. 4C are explanatory views of a welding step.
Figure 4B:
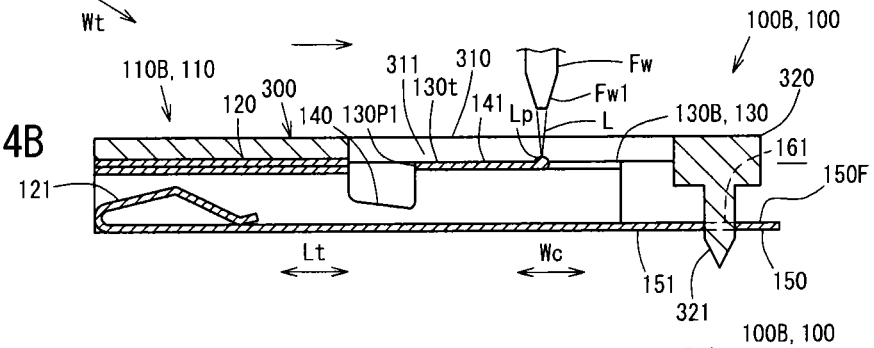
Figure 4C:
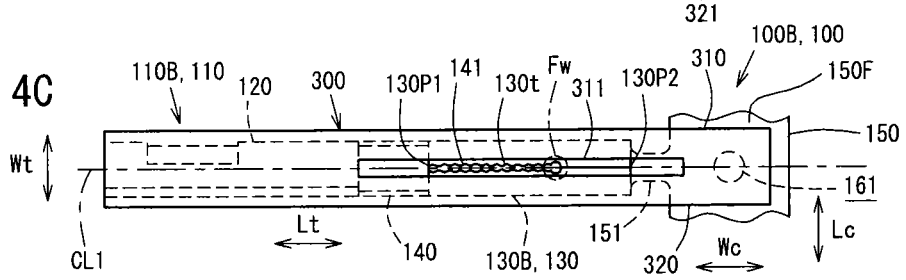

FIG. 2 is a plan view of the terminal connection strip 100A after a blanking step, and FIG. 3 is a plan view of the terminal connection strip 100B after a bending step. FIG. 4A to FIG. 4C are explanatory views of a welding step. This will be described in more detail. FIG. 4A shows a state where fiber laser welding is applied to the crimping base material 130B of the terminal connection strip 100B after the bending step, both FIG. 4B and FIG. 4C are operation explanatory views showing a state where an intermediate portion of the crimping section 130 from a distal end side to a proximal end side of the crimping section 130 are welded, FIG. 4B is a longitudinal cross-sectional view of the crimping base material 130B of the terminal connection strip 100B as viewed in the terminal width direction Wt, and FIG. 4C is a plan view of the crimping base material 130B of the terminal connection strip 100B and an area around the crimping base material 130B.

The illustration of a clamping jig 300 is omitted in FIG. 4A.

Both FIG. 5A1 and FIG. 5A2 are operation explanatory views showing a state where a proximal end portion 130P2 of the crimping base material 130B is welded, wherein FIG. 5A1 is a longitudinal cross-sectional view of the crimping base material 130B of the terminal connection strip 100B as viewed in the terminal width direction Wt, and FIG. 5A2 is a plan view showing the crimping base material 130B of the terminal connection strip 100B and an area around the crimping base material 130B.

Both FIG. 5B1 and FIG. 5B2 are operation explanatory views showing a state where a laser beam L is emitted to a connection portion 151 that connects a carrier 150, the laser beam L having passed a proximal end portion 130P2 of the crimping section 130C, wherein FIG. 5B1 is a longitudinal cross-sectional view of the crimping base material 130C of the terminal connection strip 100C as viewed in the terminal width direction Wt, and FIG. 5B2 is a plan view showing the crimping base material 130C of the terminal connection strip 100C and an area around the crimping base material 130C.

The female crimp terminal 110 can be manufactured by performing a blanking step, a bending step, a welding step, a sealing portion forming step, and a separating step in this order.

As shown in FIG. 2, the blanking step is a step where the terminal connection strip 100A is blanked from a base material.

The terminal connection strip 100A is a plate-shaped base material for forming the female crimp terminal 110, and is a copper alloy strip made of brass or the like (not shown in the drawing) and having a surface thereof plated with tin (Sn plating).

Through the blanking step, the terminal connection strip 100A is blanked from the base material into a strip shape where a plurality of terminal fittings 110A are projected from one end of the carrier 150 in the carrier width direction We by way of connection portions 151 at fixed intervals. The terminal fitting 110A has a terminal shape obtained by developing the female crimp terminal 110 in plane, and a crimping base material 130A corresponding to the crimping section 130 in a pre-crimping state includes barrel members 130*z* extending from both sides of a crimping base material 130A in the terminal width direction Wt.

In the bending step, the terminal fitting 110A in a planar state is bent so that the terminal fitting 110A is formed into a stereoscopic shape.

This will be described in more detail. As shown in FIG. 3, in the bending step, the terminal fitting 110A is bent into a stereoscopic terminal shape consisting of a box section 120 formed of a hollow quadrangular columnar body and a crimping section 130B having an approximately circular shape as viewed from a rear side.

Particularly, in the bending step, the crimping base material 130A is bent in a cylindrical shape such that the opposedly-facing edge portions 130*t* of the crimping base material 130A which face each other in an opposed manner in the circumferential direction face each other in an opposed manner at the place which is not disposed on the same plane as a carrier surface 150F of the carrier 150, at least the conductor tip 201*a* can be inserted into the crimping section 130B from a proximal end side of the crimping section 130B, and the crimping base material 130A can surround the conductor tip 201*a*.

The welding step is a step where a crimping section 130B of the terminal fitting 110B corresponding to the crimping section 130 which is connected to the wire tip 200*a* of the insulated wire 200 by crimping is bent around an axis of the terminal fitting 110B, the opposedly-facing edge portions 130*t* which face each other in an opposed manner are welded to each other by a laser beam L thus forming a cylindrical crimping section 130C.

This will be described in more detail. As shown in FIG. 4A to FIG. 4C, in a state where the opposedly-facing edge portions 130*t* of the crimping base material 130B of the terminal fitting 110B are made to abut against each other, the pair of opposedly-facing edge portions 130*t* are welded to each other while sliding a fiber laser welding device Fw from a distal end portion 130P1 (box section 120 side) of the crimping section 130B to a proximal end portion 130P2 (carrier 150 side) of the crimping section 130B along the terminal long length direction Lt, for example. Due to such welding, a welded portion 141 is formed.

Particularly, in the welding step, in a state where a focal point Lp of a laser beam L is on the opposedly-facing edge portions 130*t* of the crimping section 130B, the opposedly-facing edge portions 130*t* are welded to each other by a laser beam while making the opposedly-facing edge portions 130*t* move along the terminal long length direction Lt of the crimping section 130B (long length direction welding step).

That is, in the welding step, the welding is applied to the opposedly-facing edge portions 130*t* of the crimping base material 130A which is bent in the bending step such that the opposedly-facing edge portions 130*t* face each other in an opposed manner at the place which is not disposed on the same plane as the carrier surface 150F of the carrier 150. Accordingly, the welded portion 141 can be formed at the place which is not disposed on the same plane as the carrier surface 150F of the carrier 150.

In the welding step, as shown in FIG. 4B and FIG. 4C, the terminal fitting 110B is positioned by a clamping jig 300 constituted of a clamping jig body 310 which fixes the terminal fitting 110B and a positioning portion 320 which performs the positioning of the terminal fitting 110B.

The clamping jig body 310 is formed in an elongated manner along the terminal long length direction Lt so as to cover an upper portion of the terminal fitting 110B. A slit 311 is formed in the clamping jig body 310 along the terminal long length direction Lt so as to allow a laser beam L to be emitted to the opposedly-facing edge portions 130*t* of the terminal fitting 110B.

The positioning portion 320 is positioned on a proximal end side of the clamping jig body 310 above the carrier 150. A position of the terminal fitting 110B and a position of the clamping jig 300 are fixed by inserting a positioning jig pin 321 of the positioning portion 320 which extends downward into a positioning hole 160 formed in the carrier 150.

The sealing portion forming step is a step where a distal end side of the crimping section 130C is compressed by a crimper and an anvil not shown in the drawing until a portion of the crimping section 130C on a distal end side from the wire crimping section 131 is sealed.

Sealing property of the sealing portion 132 may be enhanced by applying welding to the sealing portion 132 while sliding the fiber laser welding device Fw along the terminal width direction Wt of the sealing portion 132 after the sealing portion forming step.

In the carrier separating step, the terminal fitting 110D is separated from the carrier 150 by cutting the connection portion 151 or the like.

In cutting the connection portion 151 in the carrier separating step, it is desirable to cut the connection portion 151 such that the connection portion 151 slightly remains on the crimping base material 130C from a boundary between the crimping base material 130C and the connection portion 151.

A specific position of a cut portion is at a position on the connection portion 151 away from the boundary between the crimping base material 130C and the connection portion 151 by a length of the remaining connection portion 151, that is, 0.1 to 0.2 mm. By setting the cutting portion in such a manner, there is no possibility that a burr is formed along with the cutting of the connection portion 151 and hence, it is possible to prevent the insulated wire 200 from being damaged by the burr after the insulated wire 200 and the female crimp terminal 110 are connected to each other by crimping.

Due to the above-mentioned steps, the female crimp terminal 110 can be manufactured using the terminal connection strip 100.

Subsequently, a process for connecting the above-mentioned female crimp terminal 110 to the wire tip 200*a* of the insulated wire 200 by crimping is described.

Firstly, the wire tip 200*a* is inserted into the wire crimping section 131 of the crimping section 130. At this point of time, a cover tip 202*a* of the wire tip 200*a* is inserted into the inside of the cover crimping section 131*a* from a rear side of the crimping section 130, and a conductor tip 201*a* of the wire tip 200*a* is inserted into the inside of the conductor crimping section 131*b*.

By crimping the wire crimping section 131 to the wire tip 200*a* by a crimping tool such as a crimper or an anvil in such a state, the female crimp terminal 110 can be connected to the wire tip 200*a* by crimping. Due to such operations, a crimp-terminal-equipped wire can be manufactured.

The crimping section 130 of the female crimp terminal 110 and the wire tip 200*a* are not necessarily connected to each other by crimping after the separating step where the terminal fitting 110D is separated from the carrier 150. The wire tip 200*a* may be connected by crimping to the terminal fitting 110D which is integrally connected to the carrier 150. When the wire tip 200*a* is connected to the terminal fitting 110D which is integrally connected to the carrier 150, the carrier separating step may be performed simultaneously with the crimping connection step where the crimping section 130 of the female crimp terminal 110 and the wire tip 200*a* are connected to each other by crimping, or may be performed after the crimping connection step.

The manner of operation and advantageous effects obtained by the above-mentioned terminal connection strip 100, and the manner of operation and advantageous effects obtained by the manufacturing method of the female crimp terminal 110 are described.

Due to the above-mentioned constitution, as shown in FIG. 4A and FIG. 4B, at least the proximal end portion 130P2 of the welded portion 141 in the terminal long length direction Lt is formed at a portion upwardly spaced apart from the carrier 150 by an amount corresponding to a diameter of the crimping section 130 such that the proximal end portion 130P2 is not disposed on the same plane as the carrier surface 150F of the carrier 150 in the circumferential direction of the crimping section 130C. Accordingly, it is possible to form a high-quality closed-barrel-type female crimp terminal 110 provided with a hollow crimping section 130 having excellent water-blocking performance and excellent conductivity, and it is also possible to efficiently manufacture such high-quality female crimp terminals 110 on a mass production basis.

This will be described in more detail. In the welding step, to bend the crimping base material 130A of the terminal fitting 110A about a terminal axis so as to weld the opposedly-facing edge portions 130*t* which face each other in an opposed manner, the fiber laser welding device Fw is moved along the terminal long length direction Lt of the crimping base material 130B while emitting the laser beam L to the opposedly-facing edge portions 130*t* from the fiber laser welding device Fw.

In the case of emitting the laser beam L to the opposedly-facing edge portions 130*t*, when the fiber laser welding device Fw reaches the proximal end portion 130P2 of the crimping section 130 in the terminal long length direction Lt as shown in FIG. 5A1 and FIG. 5A2 and, thereafter, passes the proximal end portion 130P2 and reaches the connection portion 151 between the carrier 150 and the terminal fitting 110C as shown in FIG. 5B1 and FIG. 5B2, the fiber laser welding device Fw emits the laser beam L to the connection portion 151.

According to the above-mentioned constitution, at least the proximal end portion 130P2 of the welded portion 141 in the terminal long length direction Lt is formed at the place which is not disposed on the same plane as the carrier surface 150F of the carrier 150 in the circumferential direction of the crimping section 130C. Due to such a constitution, particularly, as shown in FIG. 5B1, a focal point Lp of heat emitted from the fiber laser welding device Fw is displaced from the connection portion 151 (carrier surface 150F).

This will be described in more detail. A distance from a laser beam emitting portion Fw1 of the fiber laser welding device Fw to the carrier surface 150F is larger than a distance from the laser beam emitting portion Fw1 to the opposedly-facing edge portions 130*t* of the crimping section 130. Accordingly, the laser beam L is emitted such that a focal point of the laser beam L is on the opposedly-facing edge portions 130*t* of the crimping section 130, and a focal point Lp of the laser beam L is not on the carrier surface 150F.

Accordingly, even when the laser beam L passes through the proximal end portion 130P2 of the welded portion 141 in the terminal long length direction Lt, and is emitted to the connection portion 151 between the terminal fitting 110C and the carrier 150, a damage which is given to the connection portion 151 or the carrier 150 can be decreased so that there is no possibility that the connection portion 151 is unexpectedly melted or that a cut portion is formed on the connection portion 151. Accordingly, it is possible to maintain reliability of the connection portion 151 where the crimping base material 130C and the carrier 150 are connected to each other.

Even when the laser beam L is emitted in a state where the fiber laser welding device Fw passes the proximal end side 130P2 of the crimping section 130C in moving the fiber laser welding device Fw along the terminal long length direction Lt of the crimping section 130C, as described above, there is no possibility that the connection portion 151 is unexpectedly separated before the wire tip 200*a* is crimped to the crimping section 130.

Further, as described above, it is possible to prevent the connection portion 151 from being unexpectedly separated in welding the opposedly-facing edge portions 130*t* of the crimping section 130C by the laser beam L and hence, as shown in FIG. 5A1 and FIG. 5A2, the opposedly-facing edge portions 130*t* of the crimping section 130C can be surely welded to each other up to the proximal end portion 130P2 of the crimping section 130C in the terminal long length direction Lt.

Accordingly, the crimping section 130 can be accurately formed into a hollow shape and hence, it is possible to form a high-quality crimp terminal provided with a hollow crimping section 130 having excellent water-blocking performance and excellent conductivity.

In the terminal connection strip 100 where the plurality of terminal fittings 110D are connected to the strip-shaped carrier 150, the crimping section 130 of each terminal fitting 110D can be surely formed into a hollow shape by welding and hence, it is possible to efficiently manufacture high-quality female crimp terminals 110 on a mass production basis.

Positioning holes 160 (first positioning holes 161) each of which allows the insertion of a positioning pin which performs the positioning of the carrier 150 are formed in the carrier 150 of the terminal connection strip 100 along the carrier long length direction Lc. The positioning hole 160 is provided for each connection portion 151 which connects the terminal fitting 110D to the carrier 150. This will be described in more detail. The positioning holes 160 are formed in the carrier 150 on a center axis CL1 in the terminal width direction Wt.

According to the above-mentioned positioning hole 160, by sliding the carrier 150 along the carrier long length direction Lc in a state where the positioning pin is inserted into the positioning hole 160, the carrier 150 can be fed at fixed intervals.

Further, the crimping section 130A of the terminal fitting 110A is bent about the axis of the terminal fitting and the opposedly-facing edge portions 130*t* which face each other in an opposed manner are welded to each other. Accordingly, in emitting a laser beam L along the terminal long length direction Lt of the crimping section 130B by the fiber laser welding device Fw, by using a center 161*a* of the positioning hole 160 positioned on an extension line of the opposedly-facing edge portion 130*t* as a target, it is possible to allow the fiber laser welding device Fw to accurately emit the laser beam L to the opposedly-facing edge portions 130*t* without displacing an emitting position in the terminal width direction Wt.

Accordingly, it is possible to efficiently manufacture high-quality female crimp terminals 110 each provided with the hollow crimping section 130 with no gap on a mass production basis.

With respect to the terminal connection strip 100, a rear side (proximal end side) of the crimping section 130 is connected to the carrier 150 by way of the connection portion 151 and hence, the wire tip 200*a* can be easily inserted into the crimping section 130, and it is also possible to reduce a material cost of a base material for forming the terminal connection strip 100.

Figure 6A:
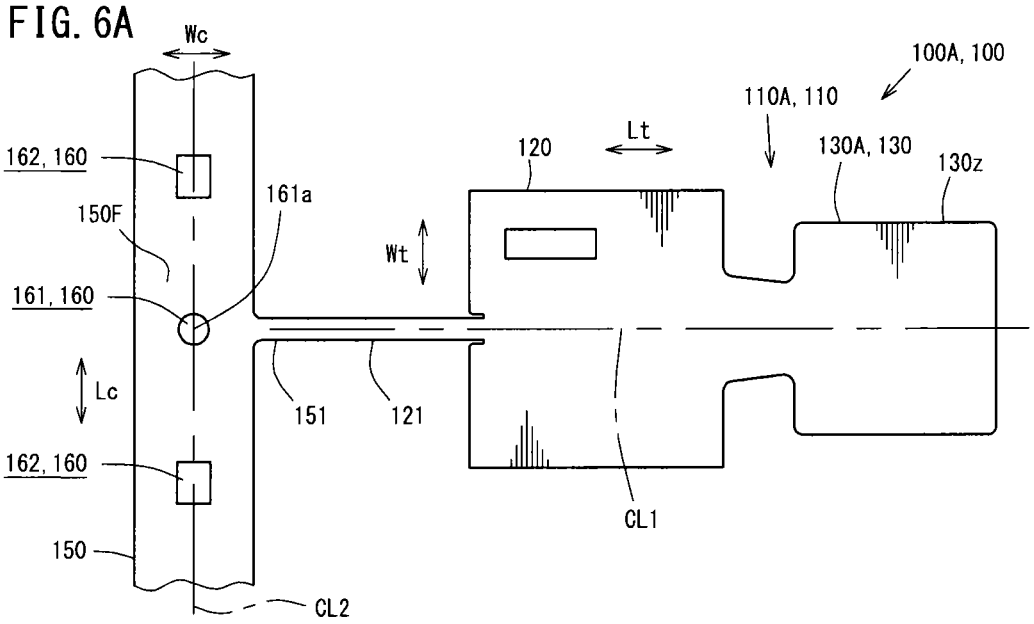
FIGS. 6A and 6B are constitutional explanatory views of other terminal connection strips according to the first embodiment.
Figure 6B:
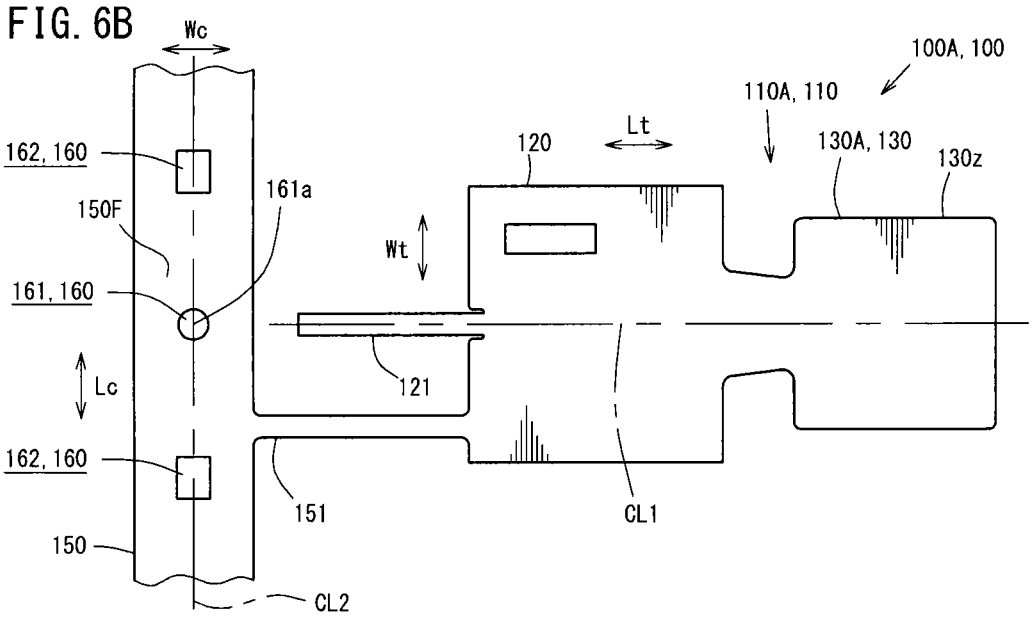

This will be described in more detail. When a box section 120 side of the terminal fitting 110A and the carrier 150 are connected to each other, as shown in FIG. 6A, a resilient contact lug 121 which projects to a distal end side from the terminal fitting 110A and the carrier 150 are connected to each other by way of the connection portion 151. Alternately, as shown in FIG. 6B, it is assumed that the box section 120 and the carrier 150 are connected to each other by way of a connection portion 151 longer than the resilient contact lug 121 at a position of the terminal fitting 110A displaced from the resilient contact lug 121 in the carrier long length direction Lc.

When the resilient contact lug 121 and the carrier 150 are connected to each other by way of the connection portion 151, the connection portion 151 including the resilient contact lug 121 is elongated. On the other hand, when the box section 120 and the carrier 150 are connected to each other by way of the connection portion 151, the connection portion 151 is elongated in a single manner. Accordingly, the terminal fitting 110A in a cantilever manner with respect to the carrier 150 is easily deflected by own weight.

The box section 120 side of the deflected terminal fitting 110D is connected to the carrier 150 and hence, even when a deflection amount of the terminal fitting 110D with respect to the carrier 150 is small, a displace amount of the crimping section 130 due to deflection is large on a rear side of the crimping section 130 into which the wire tip 200*a* is inserted. Accordingly, it becomes difficult to insert the wire tip 200*a* into the inside of the wire crimping section 131.

Further, a distance between the positioning hole 160 formed in the carrier 150 and the rear side of the crimping section 130 into which the wire tip 200*a* is inserted becomes long compared to a case where a crimping section 130 side of the terminal fitting 110A and the carrier 150 are connected to each other.

Accordingly, in a case where the terminal connection strip 100 is rotated about a center axis which passes the center of the positioning hole 160 formed in the carrier 150, even when a rotational angle is small, a displace amount of the crimping section 130 along with the rotation of the terminal connection strip 100 becomes large on a rear side of the crimping section 130. For this reason, it becomes difficult to insert the wire tip 200*a* into the inside of the wire crimping section 131.

Further, the terminal connection strip 100 having the elongated connection portion 151 requires to blank an extra material in blanking the terminal connection strip 100 from the base material in the blanking step and hence, a material cost is pushed up.

Particularly, when the resilient contact lug 121 projecting from the terminal fitting 110A to a distal end side and the carrier 150 are connected to each other by way of the connection portion 151, a boundary between a distal end portion of the resilient contact lug 121 of the terminal fitting 110A and the connection portion 151 is cut. Accordingly, there is a possibility that a burr is formed on the distal end portion of the resilient contact lug 121 along with the cutting of the connection portion 151.

When an insertion tab of a male crimp terminal not shown in the drawing is repeatedly inserted into the box section 120, there may be a case where the tab is caught by the resilient contact lug 121 on which a burr is formed on a distal end portion thereof, or the tab is damaged by the burr so that the electrical connection performance is lowered.

However, in this embodiment, a rear side of the crimping section 130 into which the wire tip 200*a* is inserted and the carrier 150 are connected to each other by way of the connection portion 151. Accordingly, it is possible to set a length of the connection portion 151 to a necessary minimum length.

Accordingly, a length of the connection portion 151 can be shortened and, at the same time, a distance between the positioning hole 160 formed in the carrier 150 and the rear side of the crimping section 130 into which the wire tip 200*a* is inserted is shortened and hence, a deformation amount of the crimping section 130 on the rear side of the crimping section 130 along with the deflection or rotation of the terminal fitting 110A can be suppressed to a minimum amount so that the wire tip 200*a* can be easily inserted into the crimping section 130.

Further, there is no possibility that a burr is formed on the distal end portion of the resilient contact lug 121 and hence, the female crimp terminal 110 can maintain favorable electrical connection performance with a male crimp terminal not shown in the drawing.

Still further, the length of the connection portion 151 can be set to a necessary minimum length and hence, a material cost can be lowered.

According to a manufacturing method of the female crimp terminal 110 of this embodiment, it is possible to accurately and efficiently manufacture a closed-barrel-type female crimp terminal 110 provided with the crimping section 130 formed into a hollow shape.

This will be described in more detail. Conventionally, a closed-barrel-type crimp terminal is manufactured by molding or brazing one by one individually.

Accordingly, products are liable to have uneven quality so that manufacturing efficiency is lowered and hence, there has been a drawback that yield rate is low.

In contrast, according to the manufacturing method of the female crimp terminal 110 of this embodiment, in a state where the positioning pin is engaged with the positioning hole 160 (particularly, the first positioning hole 161), each of the terminal fittings 110A, 110B, 110C, 110D provided to the terminal connection strip 100 can be accurately positioned with respect to the predetermined processing positions while conveying the terminal connection strip 100 to a downstream side in the processing direction.

Further, appropriate processing can be applied to the terminal fittings 110A, 110B, 110C, 110D at the predetermined processing positions.

Further, particularly, in the welding step, as described above, the opposedly-facing edge portions 130*t* which are made to abut against each other by bending a portion of the terminal fitting 110B corresponding to the crimping section 130B about an axis of the terminal fitting are welded by the fiber laser beam L thus forming the cylindrical crimping section 130C. Compared to other laser welding, an extremely small spot can be set as a focal point in the fiber laser welding and hence, it is possible to realize laser welding with high output and, at the same time, a laser beam can be emitted in a continuous manner.

Accordingly, the opposedly-facing edge portions 130*t* of the crimping section 130B can be accurately welded to each other.

As described above, according to the manufacturing method of the female crimp terminal 110 of this embodiment, particularly, the terminal connection strip 100 having the positioning holes 160 is used and, at the same time, the closed-barrel-type female crimp terminal 110 is manufactured using the fiber laser welding device Fw and hence, it is possible to manufacture the high-quality closed-barrel-type female crimp terminals 110 each provided with a crimping section 130 formed into a hollow shape with no gap on a mass production basis.

Subsequently, an embodiment different from the embodiment of the terminal connection strip 100 is described as another embodiment.

Here, the constitutions identical with the constitutions of the above-mentioned embodiment are given the same symbols, and the description of such constitutions is omitted.

Out of a plurality of positioning holes 160 formed in the terminal connection strip 100, a positioning hole 160 for every predetermined number of positioning holes 160 may have a hole shape different from a hole shape of other positioning holes 160.

This will be specifically described. The plurality of first positioning holes 161 are formed in the carrier 150 along the carrier long length direction Lc. Out of the plurality of first positioning holes 161, the first positioning hole 161 arranged for every predetermined number of first positioning holes 161 in the carrier long length direction Lc has a shape different from a hole shape of other first positioning holes 161.

Figure 7:
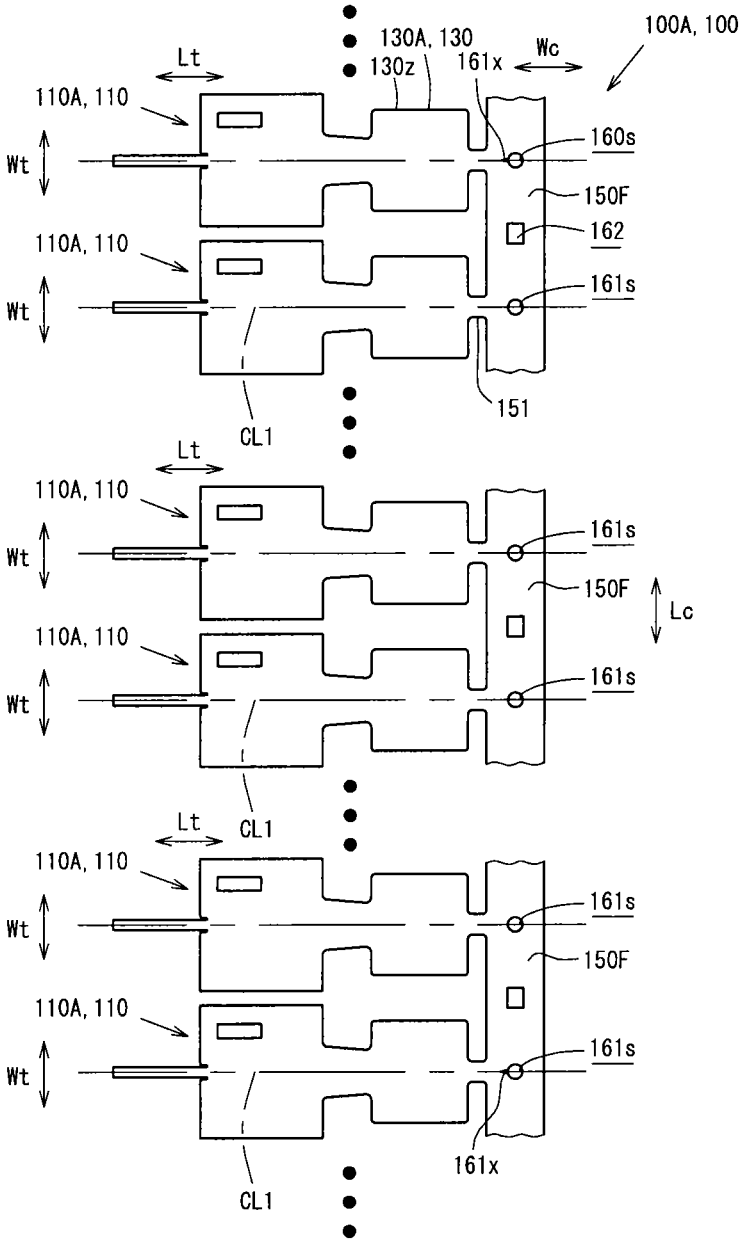
FIG. 7 is a constitutional explanatory view of another terminal connection strip according to the first embodiment.

This will be described in more detail. As shown in FIG. 7, although most of the plurality of first positioning holes 161 are formed into a perfect circular shape as described above, the first positioning hole 161 for every predetermined number of first positioning holes 161 is formed into a hole shape different from the perfect circular shape. The first positioning hole 161 having a different hole shape is set as a different-shaped first positioning hole 161*s*.

The different-shaped first positioning hole 161*s* has a cut-away portion 161*x* which is formed by cutting away a portion of a hole having a perfect circular shape in the circumferential direction.

The female crimp terminals 110 may be manufactured by applying working to a plurality of respective terminal fittings 110D which are connected to each other in the carrier long length direction Lc in a chained manner one by one while sequentially feeding the carrier 150. However, the manufacture of the female crimp terminals 110 is not limited to such a manufacturing method. A plurality of female crimp terminals 110 may be collectively manufactured in such a manner that a plurality of terminal fittings (a group of terminal fittings) 110D are set as one lot, and working is applied to the plurality of terminal fittings (a group of terminal fittings) 110D simultaneously in a collective manner on a lot-by-lot basis while feeding the carrier 150.

To realize such manufacture of the female crimp terminals 110, in this case, out of the plurality of first positioning holes 161 arranged in the carrier long length direction Lc, it is desirable to form the different-shaped first positioning hole 161*s* for every predetermined number of terminal fittings 110D included in each group of terminal fittings which constitute one lot.

Accordingly, the plurality of female crimp terminals 110 can be collectively manufactured by simultaneously applying working to a group of terminal fittings on a lot-by-lot basis while feeding the carrier 150 in a state where the positioning pin is inserted for every different-shaped first positioning hole 161*s* arranged in the carrier long length direction Lc.

In manufacturing steps, there may be case where a defect occurs in working a certain terminal fitting 110D out of the plurality of terminal fittings 110D which are connected in series in a chained manner in a carrier long length direction Lc. In the above-mentioned constitution, in this embodiment, the different-shaped first positioning hole 161*s* is formed for every predetermined number of terminal fittings 110D included in each group of terminal fittings which constitute one lot. If it is possible to identify a lot in which a defect occurs, the position of a different-shaped first positioning hole 161*s* corresponding to the lot can be identified in the carrier long length direction Lc. By identifying the position of the different-shaped first positioning hole 161*s* in this manner, terminal fittings 110D included in the lot can be easily allocated so that the certain terminal fitting 110D in which the defect occurs can be easily and surely identified.

Accordingly, the plurality of female crimp terminals 110 can be efficiently manufactured in a continuous manner from the plurality of terminal base materials 110A connected in a chain state in the carrier long length direction Lc on the mass production basis.

A shape of the first positioning hole 161, a shape of the different-shaped first positioning hole 161*s*, and a shape of the second positioning hole 162 are not limited to the above-mentioned shapes, and may be other shapes.

Further, provided that the terminal connection strip of the present invention adopts the constitution where, at least on the proximal end side of the crimping section 130 in the terminal long length direction Lt, the welded portion 141 is formed at the place which is not disposed on the same plane as the carrier surface 150F of the carrier 150 in the circumferential direction of the crimping section 130, the constitution of the terminal connection strip is not limited to the above-mentioned terminal connection strip 100, and the terminal connection strip may adopt a constitution of another embodiment.

For example, as in the case of a terminal connection strip 100Pa shown in FIG. 8A, the terminal connection strip may include a terminal fitting 110Pa provided with a sealing portion 132 having a shape deformed in the thickness direction by compression on a distal end side of the crimping section 130 such that a base material faces each other on an upper surface side of the terminal fitting 110Pa.

Alternatively, as in the case of a terminal connection strip 100Pb shown in FIG. 8B1, the terminal connection strip may include a terminal fitting 110Pb where a box section 120 and a crimping section 130 are formed separately, and the box section 120 and the crimping section 130 are integrally connected to each other at a transition section 140 as shown in FIG. 8B2.

With respect to both the terminal connection strip 100Pa shown in FIG. 8A and the terminal connection strip 100Pb shown in FIG. 8B2, the welded portion 141 is formed at the place which is not disposed on the same plane as a carrier surface 150F of the carrier 150. Accordingly, in the same manner as the above-mentioned terminal connection strip 100, it is possible to acquire the advantageous effect that the high-quality crimp terminal provided with the hollow crimping section 130 can be manufactured efficiently and, at the same time, the crimping section 130 can be crimped to the conductor tip 201*a* in a crimped state with excellent water-blocking performance and excellent conductivity.

As described above, in this embodiment, in the welding step, the pair of opposedly-facing edge portions 130*t* is welded to each other while sliding the fiber laser welding device Fw along the terminal long length direction Lt from the distal end portion 130P1 (box section 120 side) of the crimping section 130B to a proximal end portion 130P2 (carrier 150 side) of the crimping section 130B thus forming the welded portion 141 at the opposedly-facing edge portion 130*t* (see FIG. 4A to FIG. 4C). However, a welding method and the constitution are not limited to such a welding method and constitution.

This will be specifically described. The method of welding is not limited to that the fiber laser welding device Fw is moved along the terminal long length direction Lt of the crimping section 130B. At least one of the fiber laser welding device Fw and the terminal fitting 110B may be moved such that a laser beam L emitted from the fiber laser welding device Fw is emitted to the opposedly-facing edge portions 130*t* of the crimping section 130B along the terminal long length direction Lt.

The method of welding is not limited to that the opposedly-facing edge portions 130*t* of the crimping section 130B are welded to each other while moving at least one of the fiber laser welding device Fw and the terminal fitting 110B. The fiber laser welding may be performed using a mirror called a galvano mirror not shown in the drawing.

The galvano mirror is a mirror which reflects a laser beam for scanning and, at the same time, is rotated by an amount corresponding to a level of an inputted drive voltage for allowing the laser beam to be polarized at a reflection angle of a desired angle.

According to the above-mentioned constitution, even when at least one of the fiber laser welding device Fw and the terminal fitting 110B is not moved, by performing the sweep irradiation of the laser beam L emitted from a head of the fiber laser welding device Fw arranged at a fixed point based on an oscillation angle of the galvano mirror with respect to opposedly-facing edge portions 130*t* of the crimping section 130B of the terminal fitting 110B arranged at another fixed point, the opposedly-facing edge portions 130*t* can be surely welded.

Even when the laser beam L passes the proximal end portion 130P2 of the crimping section 130B due to the oscillation angle of the galvano mirror and is emitted to the connection portion 151, a focal point Lp of the laser beam L emitted from the fiber laser welding device Fw is not on the connection portion 151 (carrier surface 150F). Accordingly, there is no possibility that the connection portion 151 is unexpectedly melt or a cut portion is formed on the connection portion 151 and hence, the welded portion 141 can be accurately formed on the opposedly-facing edge portions 130*t* of the crimping section 130B.

Figure 9A:
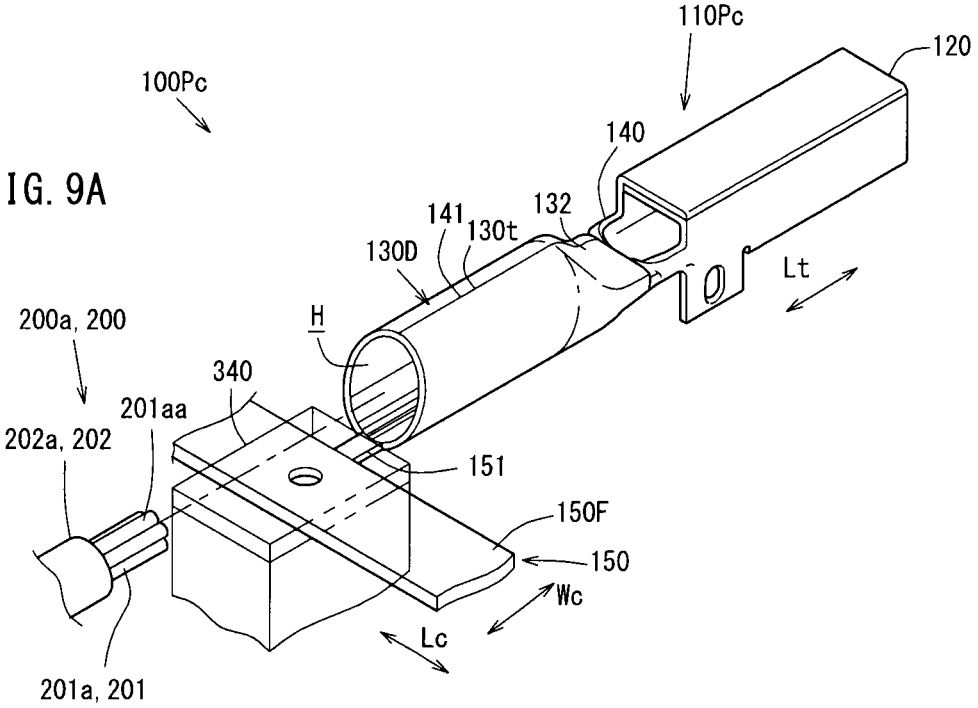
FIG. 9A and FIG. 9B are constitutional explanatory views of another terminal connection strip according to the first embodiment.

As another embodiment, for example, as in the case of a terminal connection strip 100Pc shown in FIG. 9A, the terminal connection strip may include a terminal fitting 110Pc provided with a crimping section 130D where an orthogonal cross section of the crimping section 130D which is taken along a line orthogonal to the terminal long length direction Lt has an elliptical circular shape.

The crimping section 130D is formed into an elliptical circular shape having a long axis in the vertical direction in cross section.

Figure 9B:
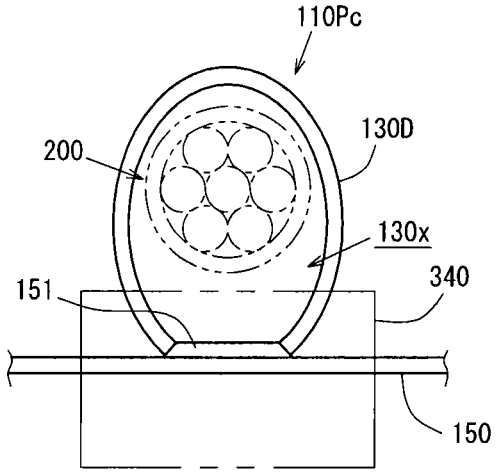

According to the above-mentioned constitution, as shown in FIG. 9B, even when the carrier cutting device 340 is arranged on a carrier 150 side of the terminal fitting 110Pc, there is no possibility that a wire insertion opening 130*x* having an elliptical circular shape of the crimping section 130D on a proximal end side is completely closed by the carrier cutting device 340 and hence, the wire insertion opening 130*x* can ensure a size which allows the insertion of the wire tip 200*a*.

Accordingly, at the time of inserting the wire tip 200*a* into the inside of the crimping section 130D of the terminal fitting 110Pc from the carrier 150 side, the wire tip 200*a* can be surely inserted into the inside of the crimping section 130D avoiding the interference with the carrier cutting device 340.

The constitution of the carrier of the present invention is not limited to the constitution where the first positioning hole 161 and the second positioning hole 162 are formed in the carrier as the above-mentioned positioning hole 160, wherein the first positioning hole 161 and the second positioning hole 162 are used at the time of feeding the terminal connection strip 100 along the carrier long length direction Lc by allowing the insertion of the positioning pin which a carrier feeding mechanism not shown in the drawing includes.

Figure 10A:
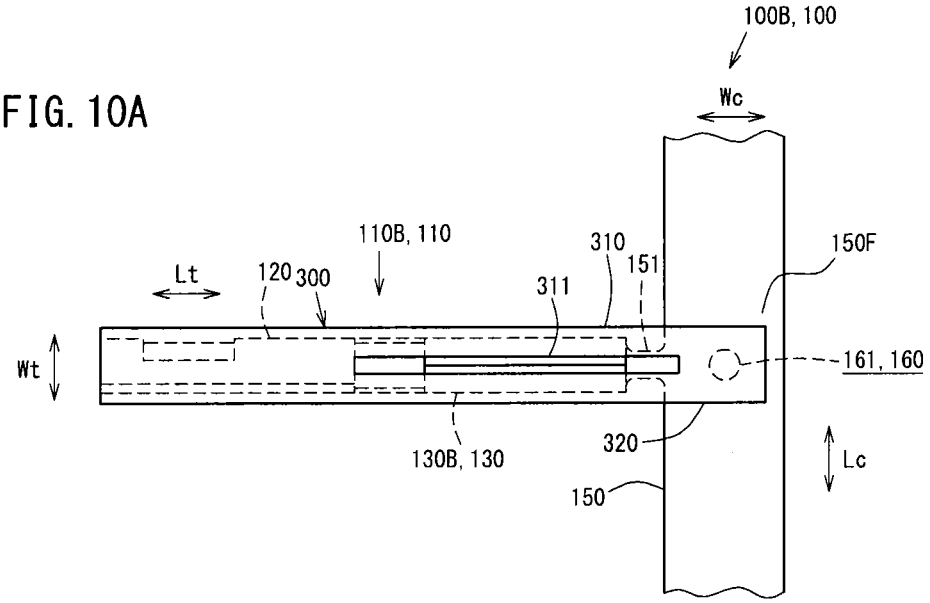
FIGS. 10A and 10B are constitutional explanatory views of other terminal connection strips according to the first embodiment.
Figure 10B:
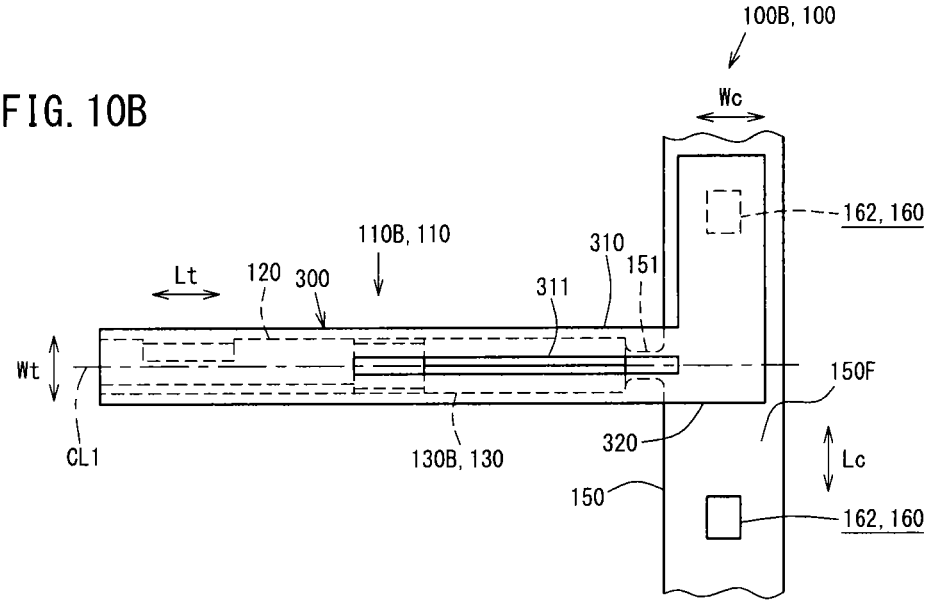

For example, the carrier may adopt the constitution shown in FIG. 10A where only the first positioning holes 161 are formed in the carrier, or the constitution shown in FIG. 10B where only the second positioning holes 162 are formed on the carrier.

In the case of the carrier 150 where only the first positioning holes 161 are formed on the carrier 150, as shown in FIG. 10A, the first positioning hole 161 is arranged at a position on the terminal long length direction Lt of the welded portion 141 of the terminal fitting 110B, that is, on an extension line of the welded portion 141. Accordingly, a distance from a positioning jig pin 321 inserted into the first positioning hole 161 to the terminal fitting 110B can be set to a minimum distance and hence, the clamping jig 300 can be small sized.

Further, by making the clamping jig 300 small-sized, a moving amount (stroke amount) of the clamping jig 300 or the like can be set to a minimum value and hence, an operation time in the welding step can be shortened.

On the other hand, in the case of the carrier 150 where only the second positioning holes 162 are formed in the carrier 150, when the positioning hole 160 is set at a position displaced from the connection portion 151 in the carrier long length direction Lc as shown in FIG. 10B, it is possible to acquire the advantageous effect that the reliability of a connection state of the terminal connection strip 100 where the crimping section 130 and the carrier 150 are connected to each other can be maintained without lowering the strength of a portion of the carrier 150 in the vicinity of the connection portion 151.

That is, the constitution of the positioning holes 160 can be suitably set according to a specification of the female crimp terminal 110 to be manufactured, manufacturing conditions or the like. That is, the positioning holes 160 may be formed only of the first positioning holes 161 or formed only of the second positioning holes 162. Alternatively, the positioning holes 160 may be formed by both the first positioning holes 161 and the second positioning holes 162.

Further, in a pre-crimping state, a shape of the cover crimping section 131*a* and a shape of the conductor crimping section 131*b* of the present invention are not limited to cylindrical shapes having a substantially equal diameter.

For example, the crimping section 130 may be formed into a so-called bellmouth shape where a diameter of a proximal end portion of the cover crimping section is increased compared to other portions of the cover crimping section for allowing the conductor crimping section to have a diameter narrower than a diameter of the cover crimping section. Alternatively, as shown in FIG. 11A to FIG. 11C, the crimping section 130 may be formed such that the cover crimping section and the conductor crimping section have different diameters by forming a stepped portion at a boundary portion between the cover crimping section 1310*a* and the conductor crimping section 1310*b*.

Figure 11A:
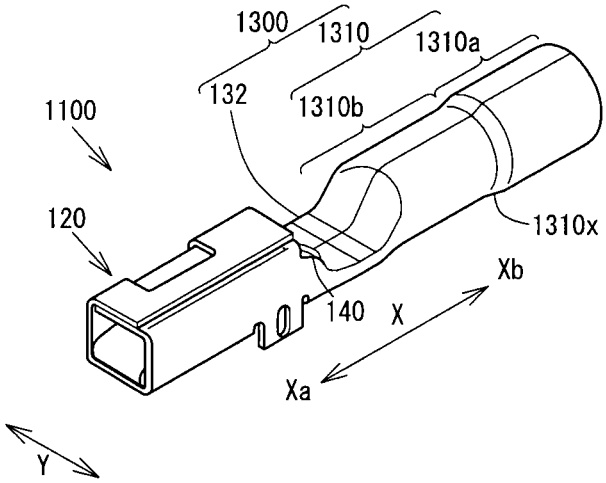
FIG. 11A to FIG. 11C are constitutional explanatory views of another female crimp terminal according to the first embodiment.
Figure 11B:
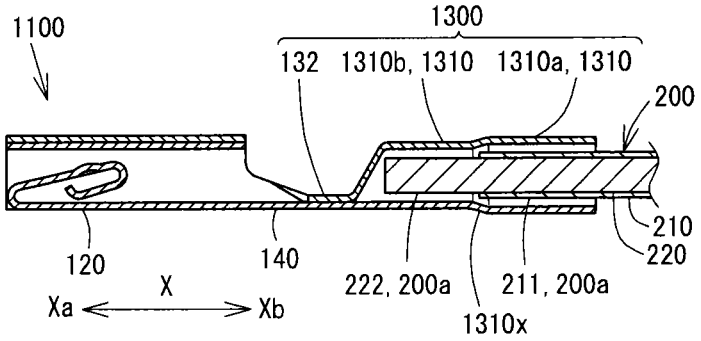
Figure 11C:
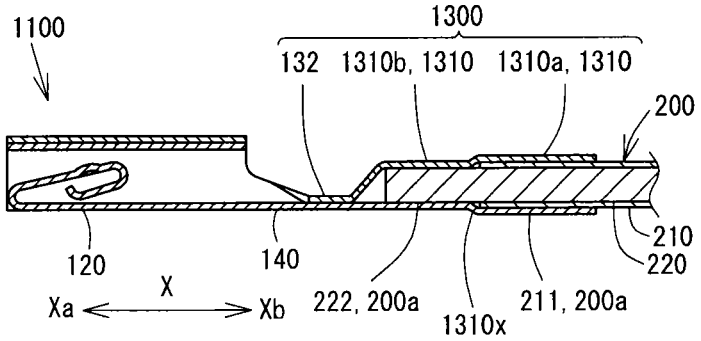

FIG. 11A is a perspective view of the female crimp terminal 1100, FIG. 11B is a longitudinal cross-sectional view describing a state after the wire inserting step, and FIG. 11C is a longitudinal cross-sectional view describing a state after the crimping connection step.

When the proximal end portion of the cover crimping section is formed into a bellmouth shape, it is possible to prevent the state where a rear end portion of the cover crimping section bites into the insulating cover 202 in a post-crimping state with the wire tip 200*a* thus damaging the insulating cover 202. Accordingly, the high-quality crimp-terminal-equipped wire (not shown in the drawing) can be formed.

On the other hand, in the case of a wire crimping section 1310 where a boundary portion between the cover crimping section 1310*a* and the conductor crimping section 1310*b* is formed into a stepped shape, a deformation amount of the conductor crimping section 1310*b* at the time of crimping the conductor crimping section 1310*b* to the wire tip 200*a* can be reduced compared to the conductor crimping section 131*b* of the wire crimping section 131 where a stepped portion is not formed at a boundary portion.

It is preferable that an inner diameter of the cover crimping section 1310*a* is set substantially equal to or slightly larger than an outer diameter of the cover tip 202*a* and, at the same time, an inner diameter of the conductor crimping section 1310*b* is set substantially equal to or slightly larger than an outer diameter of the conductor tip 201*a*.

The stepped portion 1310*x* of the wire crimping section 1310 where the cover crimping section 1310*a* and the conductor crimping section 1310*b* are formed in a stepwise manner is not formed into a stepped shape which is orthogonal to the terminal long length direction Lt, but is formed into a stepped shape gradually and smoothly lowered from the cover crimping section 1310*a* to the conductor crimping section 1310*b*.

Although there are various kinds of manufacturing methods of such a female crimp terminal 1100 where the boundary portion between the cover crimping section 1310*a* and the conductor crimping section 1310*b* is formed into a stepped shape, it is preferable to manufacture the female crimp terminal 1100 using a core rod 330 as shown in FIG. 12A to FIG. 12D.

Figure 12A:
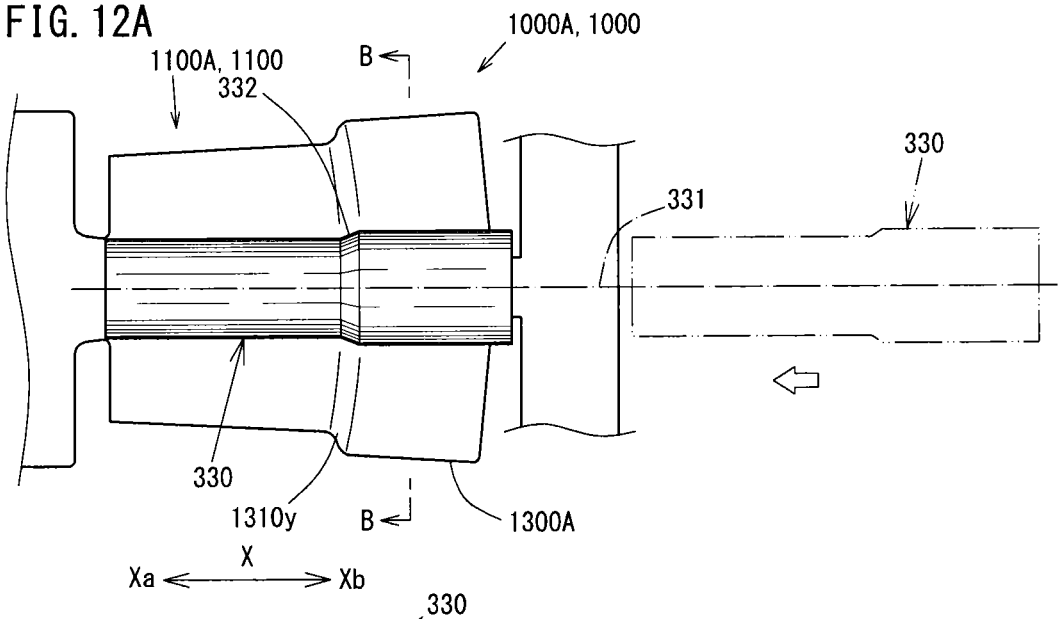
FIG. 12A to FIG. 12D are explanatory views of a manufacturing method of another female crimp terminal according to the first embodiment.
Figure 12B:
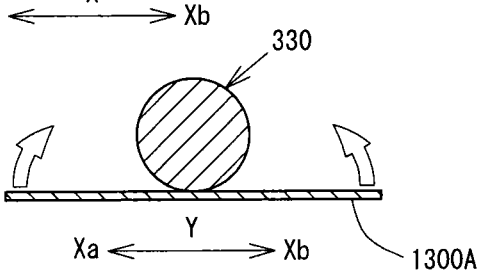
Figure 12D:
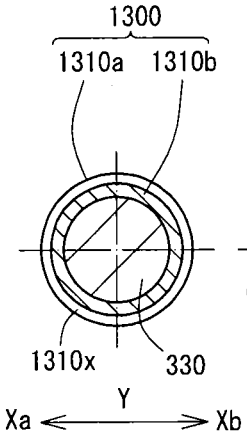
Figure 12C:
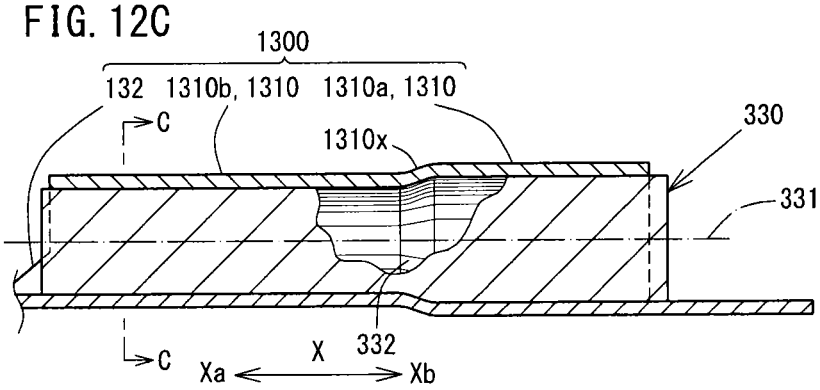

FIG. 12A is a plan view showing a state where the core rod 330 is placed on a crimping base material 1300A, FIG. 12B is a cross-sectional view taken along line B-B in FIG. 12A, FIG. 12C is a longitudinal cross-sectional view showing a state where the crimping section 1300 is formed into a hollow shape, and FIG. 12D is a cross-sectional view taken along line C-C in FIG. 12C.

The manufacturing method of the female crimp terminal 1100 using the core rod 330 will be described in more detail. Firstly, a terminal base material is blanked into a shape obtained by developing the hollow crimping section 1300 formed into a stepped shape in plane.

Then, in a state where a core rod axis 331 of the core rod 330 formed into a stepped shape extends along the long length direction X, the core rod 330 is placed on the terminal base material such that, as shown in FIG. 12A, a stepped portion 332 of the core rod 330 is positioned at a stepped portion corresponding portion 1310*y* which corresponds to a stepped portion 1310*x* of the wire crimping section 1310.

Next, as shown in FIG. 12B, both end portions of the crimping base material 1300A in the terminal width direction Wt are bent about the core rod axis 331 and, as shown in FIG. 12C and FIG. 12D, the crimping base material 1300A is formed into a hollow shape which surrounds the core rod 330 by a press die not shown in the drawing.

Subsequently, the manner of operation and advantageous effects of the female crimp terminal 1100 formed as described above is described by reference to FIG. 13 and FIG. 14.

Figure 13:
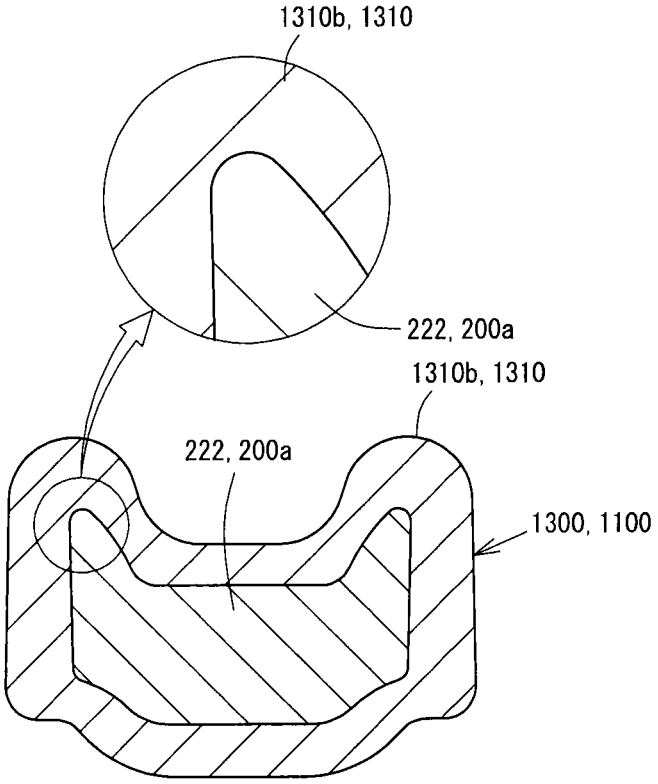
FIG. 13 is a cross-sectional view of another female crimp terminal according to the first embodiment.
Figure 14:
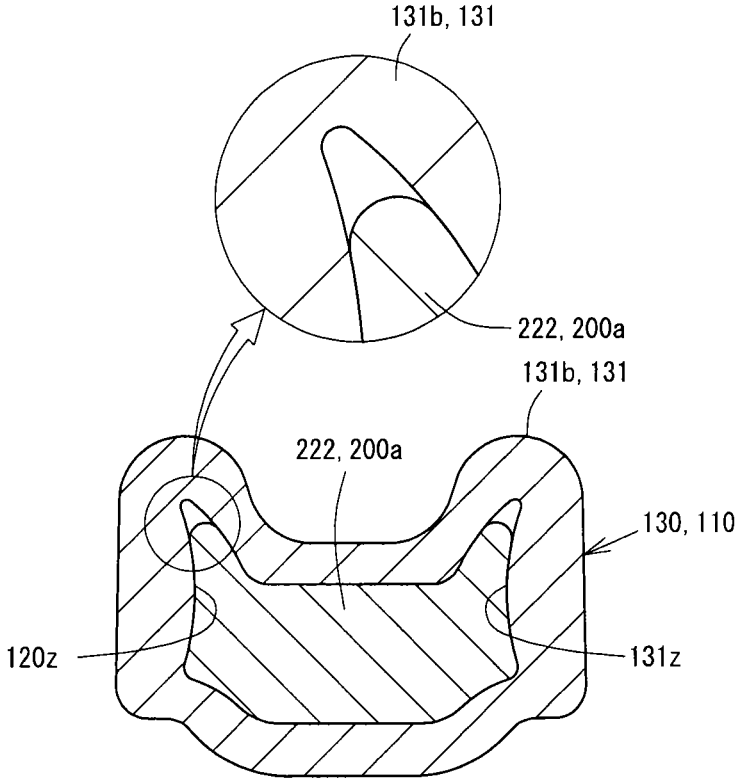
FIG. 14 is a cross-sectional view of a conventional female crimp terminal.

FIG. 13 is a cross-sectional view of the conductor crimping section 1310*b* and the conductor tip 201*a* in a state where the conductor crimping section 1310*b* and the conductor tip 201*a* are connected to each other by crimping with the wire crimping section 1310 formed into a stepped shape. FIG. 14 is a cross-sectional view of the conductor crimping section 131*b* and the conductor tip 201*a* in a state where the conductor crimping section 131*b* and the conductor tip 201*a* are connected to each other by crimping with the wire crimping section 131 not formed into a stepped shape.

With respect to the conductor crimping section 1310*b* of the wire crimping section 1310 where a boundary portion between the cover crimping section 1310*a* and the conductor crimping section 1310*b* is formed into a stepped shape, compared to the conductor crimping section 131*b* of the wire crimping section 131 where a boundary portion is not formed into a stepped shape, a deformation amount of the conductor crimping section 1310*b* at the time of crimping the conductor crimping section 1310*b* to the wire tip 200*a* can be reduced so that an amount of an excessively large thick wall portion generated at the conductor crimping section 1310*b* along with the crimping can be reduced.

Assume a case where, in a pre-crimping state, the cover crimping section 131*a* and the conductor crimping section 131*b* are formed into cylindrical shapes having a substantially equal diameter, that is, the cover crimping section 131*a* and the conductor crimping section 131*b* are not formed into a stepped manner. In such a case, an amount of deformation along with the crimping is large in the conductor crimping section 131*b* crimped to the conductor tip 201*a* than in the cover crimping section 131*a* crimped to the cover tip 202*a*. Accordingly, an excessively large thick wall portion is generated at the conductor crimping section 131*b*.

Assuming that a crimped shape of the crimping section 130 is an approximately U shape in cross section, the excessively large thick wall portion generated at the conductor crimping section 131*b* forms an inwardly-falling portion 131*z* which projects in a falling manner toward the center of the wire crimping section 131 as shown in FIG. 14.

In such a case, the inwardly-falling portion 131*z* serves as an obstacle when the conductor crimping section 131*b* and the conductor tip 201*a* are crimped to each other. Accordingly, as shown in an enlarged view in FIG. 14, the conductor tip 201*a* does not reach a corner portion of the conductor crimping section 131*b* and hence, there exists a possibility that a gap is generated between the conductor crimping section 131*b* and the conductor tip 201*a*.

The wire crimping section 131 where the gap is generated between the conductor crimping section 131*b* and the conductor tip 201*a* has, in a state where the conductor crimping section 131*b* and the conductor tip 201*a* are connected to each other by crimping, the deteriorated electrical connection or the moisture intrusion due to the capillarity. Accordingly, such a wire crimping section 131 has deteriorated electrical characteristics.

On the other hand, by forming the boundary portion between the cover crimping section 1310*a* and the conductor crimping section 1310*b* into a stepped shape, a gap formed between the conductor crimping section 1310*b* and the conductor tip 201*a* becomes smaller than a gap formed between the conductor crimping section 131*b* and the conductor tip 201*a* in the case where the boundary portion between the cover crimping section 131*a* and the conductor crimping section 131*b* is not formed into a stepped shape.

Accordingly, as shown in FIG. 13, an amount of deformation of the conductor crimping section 1310*b* along with the crimping can be decreased so that the generation of the excessively large thick wall portion can be suppressed. Accordingly, the generation of the inwardly-falling portion at the conductor crimping section 1310*b* can be prevented so that the conductor crimping section 1310*b* and the conductor tip 201*a* can be closely connected to each other by crimping.

Further, the stepped portion 1310*x* of the wire crimping section 1310 is formed into a stepped shape which is gradually and smoothly lowered from the cover crimping section 1310*a* to the conductor crimping section 1310*b*. Accordingly, the wire tip 200*a* can be easily inserted into the wire crimping section 1310.

Further, as described above, the female crimp terminal 1100 is manufactured using the core rod 330. Accordingly, even when the female crimp terminals 1100 are manufactured on a mass production basis, there is no possibility that a position of the stepped portion 1310*x* of the wire crimping section 1310 is changed for every female crimp terminal 1100. That is, the stepped portion 1310*x* of the wire crimping section 1310 can be formed at a desired position.

This will be described in more detail. For example, assume a case where the conductor crimping section is formed with a length larger than a desired length in the terminal long length direction Lt. In such a case, when an inner diameter of the cover crimping section 1310*a* is set substantially equal to or slightly larger than an outer diameter of the cover tip 202*a*, and an inner diameter of the conductor crimping section 1310*b* is set substantially equal to or slightly larger than an outer diameter of the conductor tip 201*a* as described above, the cover tip 202*a* may be caught by the stepped portion of the wire crimping section at the time of inserting the wire tip 200*a* into the wire crimping section. Accordingly, there exists a possibility that the wire tip 200*a* cannot be firmly inserted into the wire crimping section.

On the other hand, assume a case where the cover crimping section is formed with a length larger than a desired length in the terminal long length direction Lt. In such a case, even when the conductor tip 201*a* is made to abut against a distal end side of the wire crimping section, the insertion of the wire tip 200*a* may be continued until the cover tip 202*a* is made to abut against the stepped portion of a crimping section body. Accordingly, there exists a possibility that the conductor tip 201*a* is bent.

Further, assume a case where the cover crimping section is formed with a length larger than a desired length in the terminal long length direction Lt. In such a case, even when the insertion of the wire tip 200*a* is stopped immediately before the conductor tip 201*a* is made to abut against a distal end of the wire crimping section, a cover crimping section is positioned around the conductor tip 201*a* at the boundary portion between the conductor tip 201*a* and the cover tip 202*a*.

Accordingly, a gap formed between the conductor tip 201*a* at the boundary portion between the conductor tip 201*a* and the cover tip 202*a* and the wire crimping section becomes larger than a gap formed between a distal end side of the conductor tip 201*a* and the wire crimping section. That is, the conductor crimping section in such a case has a possibility of forming an inwardly-falling portion at the time of connecting the conductor crimping section to the conductor tip 201*a* by crimping.

However, in the female crimp terminal 1100 where the stepped portion 1310*x* is formed at a desired position, the wire tip 200*a* can be inserted into the wire crimping section 1310 at a desired position without giving rise to a drawback that the insertion of the wire tip 200*a* into the wire crimping section 1310 is insufficient, a drawback that the distal end of the conductor tip 201*a* is bent, or a drawback that a gap formed between the conductor crimping section 1310*b* and the conductor tip 201*a* becomes large.

The desired position is a position on the terminal long length direction Lt where the boundary portion between the conductor tip 201*a* and the cover tip 202*a* corresponds to the stepped portion 1310*x* of the wire crimping section 1310.

Accordingly, by forming the crimping section 1300 into a hollow shape in a state where the stepped portion corresponding portion 1310*y* of the crimping base material 1300A and the stepped portion 332 of the core rod 330 are accurately aligned with each other, the wire crimping section 1310 and the wire tip 200*a* can maintain a state where the wire crimping section 1310 and the wire tip 200*a* are closely connected to each other by crimping. Accordingly, it is possible to acquire a wire provided with a terminal having favorable electrical connection performance.

(Second Embodiment)

Another embodiment is described.

The same symbols are applied to the constitution similar to the constitution of the above-mentioned first embodiment and the explanation of the constitution is omitted.

Figure 15:
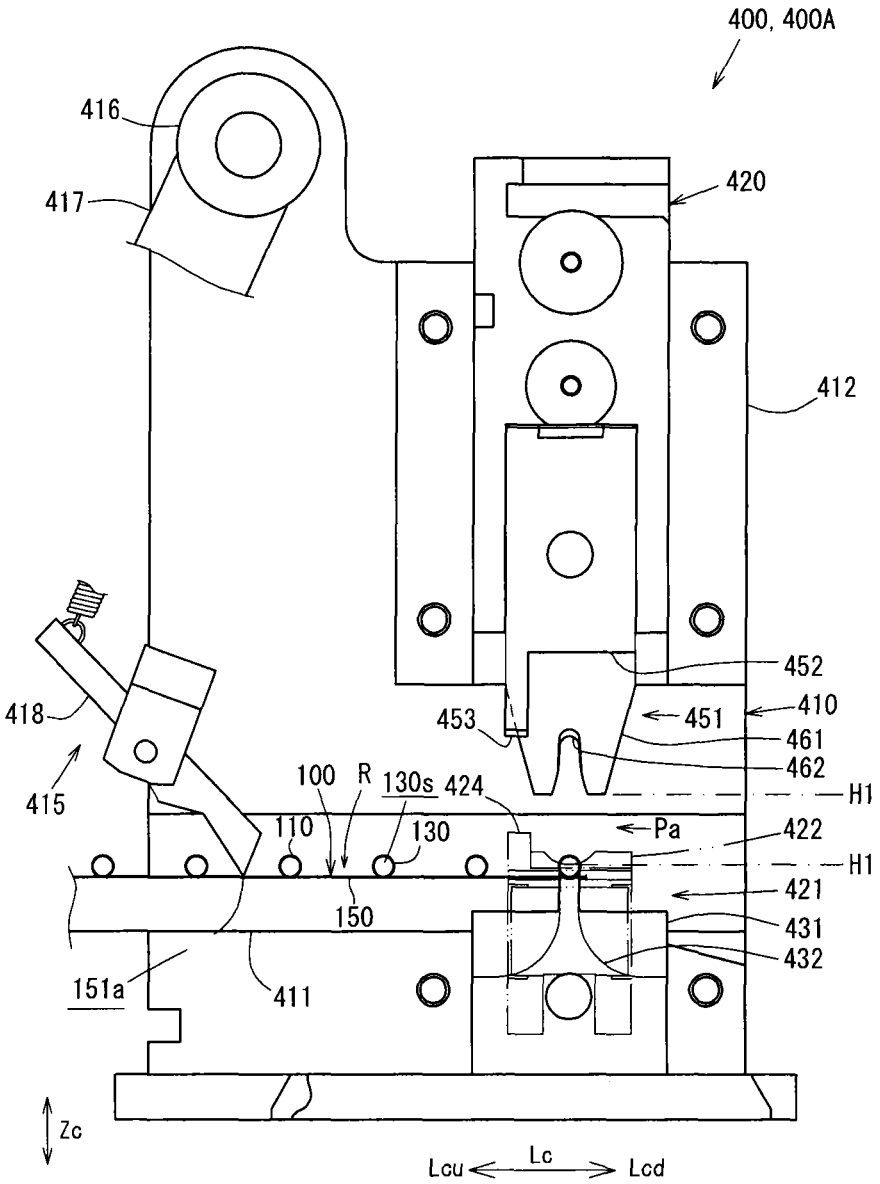
FIG. 15 is a front view of a wire crimping device according to a second embodiment.
Figure 16:
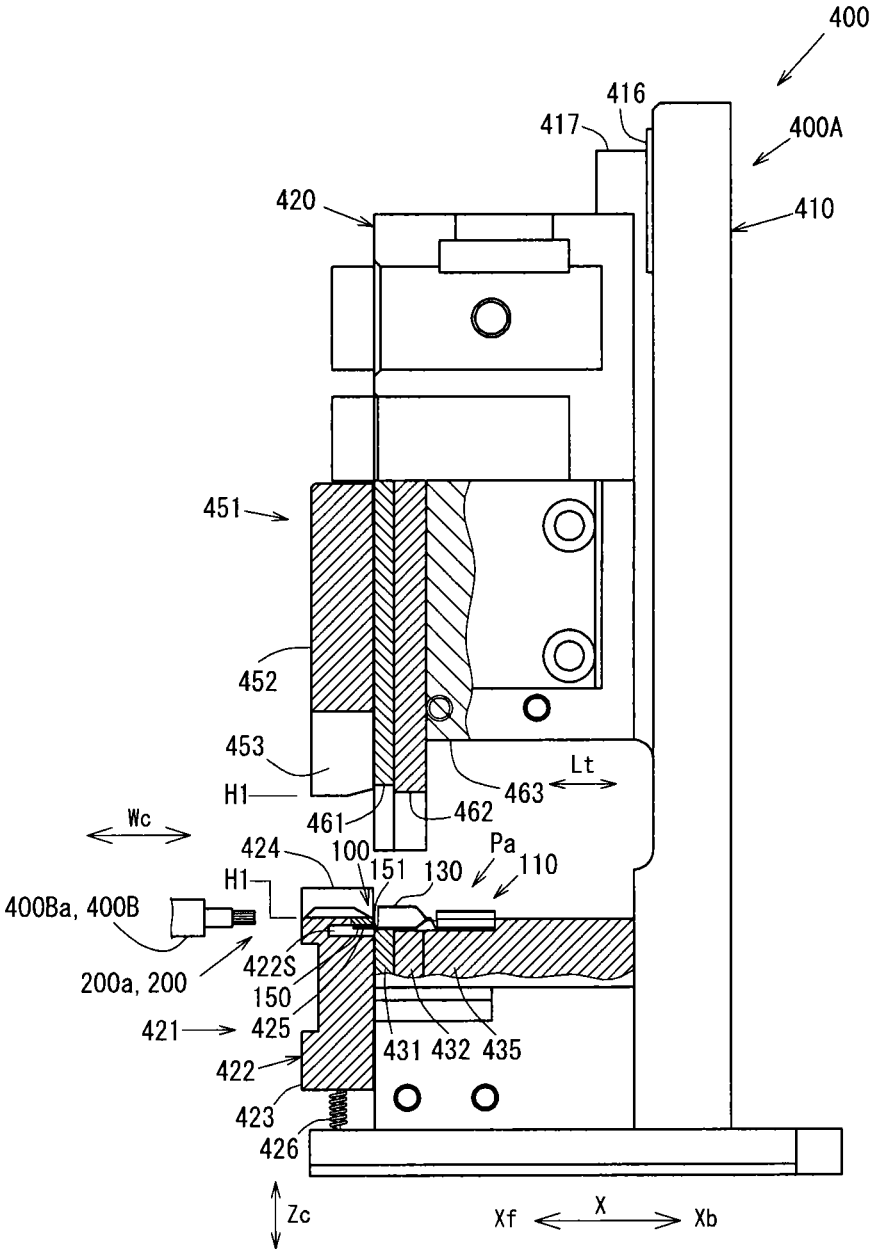
FIG. 16 is a right side view with a part in cross section of the wire crimping device.

FIG. 15 is a front view showing the overall structure of a wire crimping device 400, FIG. 16 is a right side view showing the overall structure of the wire crimping device 400 partially described in a cross section, and FIG. 17A to FIG. 17C are constitutional explanatory views of an anvil jig 421 and a crimper jig 451. This will be described in more detail. FIG. 17A is a front view of a wire crimping area Pa of the wire crimping device 400 and an area around the wire crimping area Pa before carrier cutting, and FIG. 17B is a longitudinal cross-sectional view of the wire crimping area Pa of the wire crimping device 400 and the area around the wire crimping area Pa before carrier cutting.

Figure 18A:
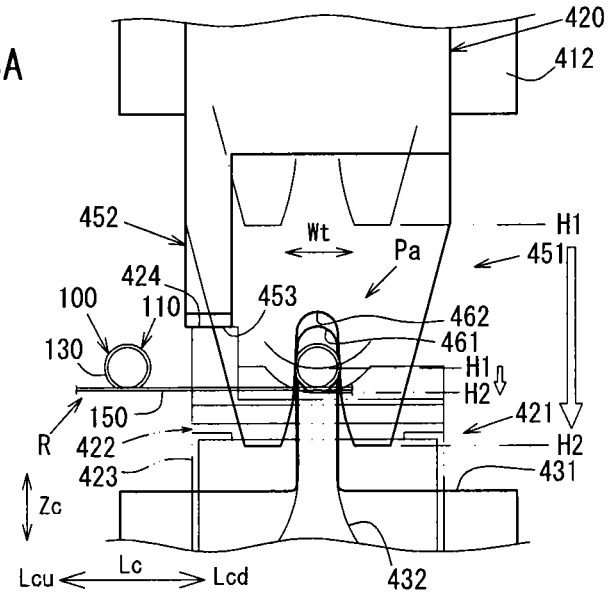
FIG. 18A and FIG. 18B are operational explanatory views of a carrier cutting step.
Figure 18B:
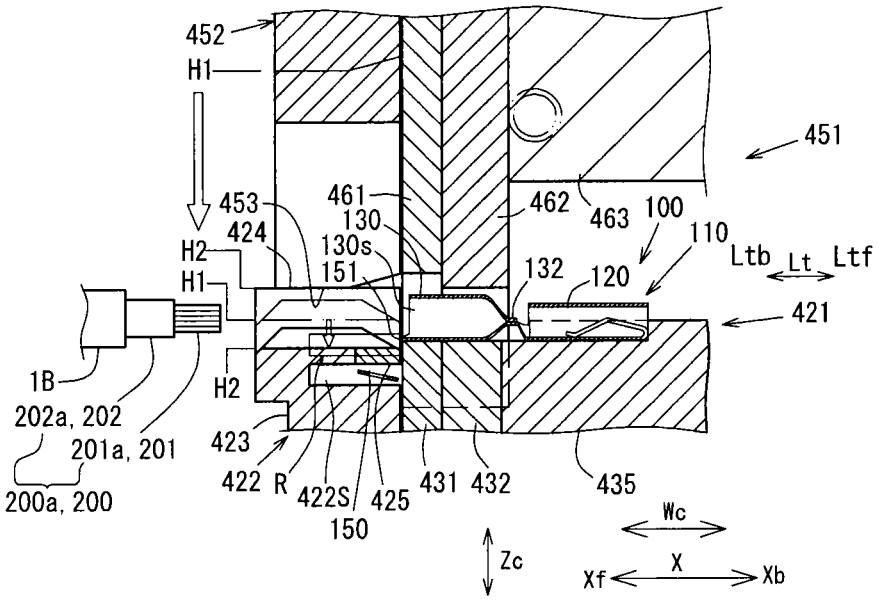

FIG. 17C is an enlarged view of part "X" in FIG. 17B. FIG. 18A and FIG. 18B are constitutional explanatory views of the anvil jig 421 and the crimper jig 451. This will be described in more detail. FIG. 18A is a front view of the wire crimping area Pa of the wire crimping device 400 and an area around the wire crimping area Pa during a carrier cutting step, and FIG. 18B is a longitudinal cross-sectional view of the wire crimping area Pa of the wire crimping device 400 and the area around the wire crimping area Pa during the carrier cutting step.

Figure 19A:
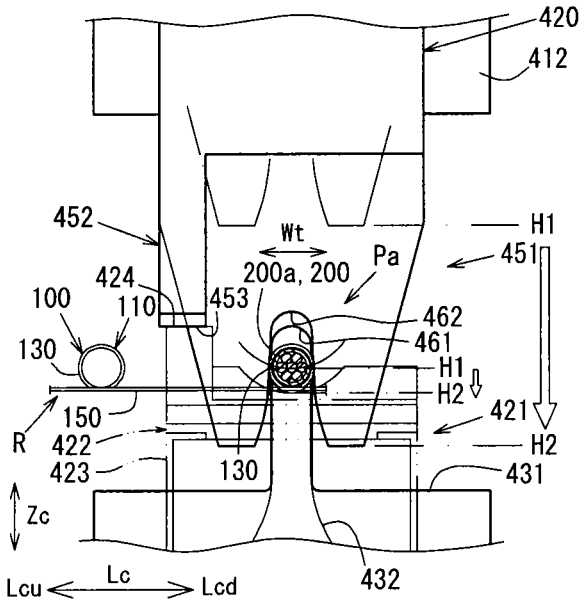
FIG. 19A and FIG. 19B are operational explanatory views of a wire inserting step.
Figure 19B:
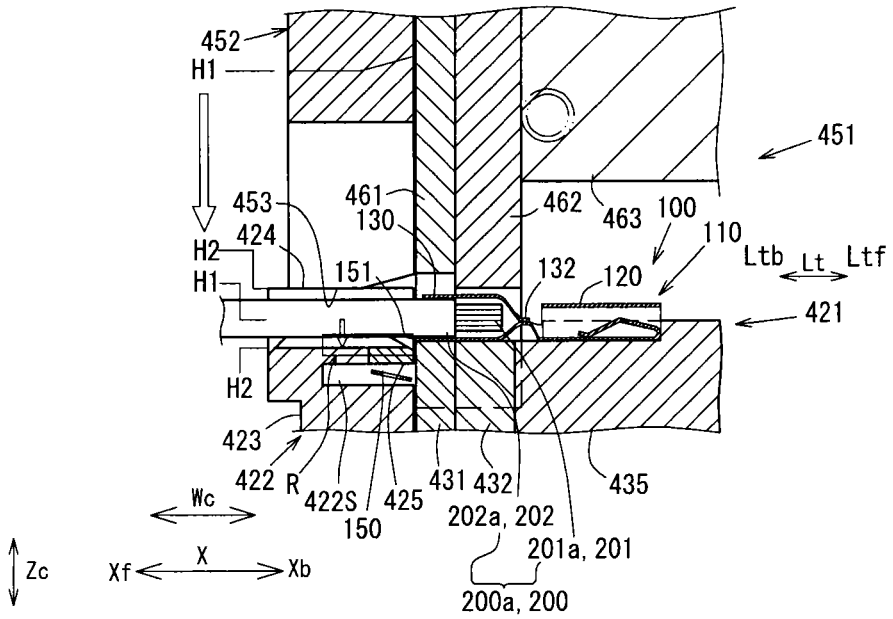

FIG. 19A and FIG. 19B are constitutional explanatory views of the anvil jig 421 and the crimper jig 451. FIG. 19A is a front view of the wire crimping area Pa of the wire crimping device 400 and an area around the wire crimping area Pa during a wire inserting step, and FIG. 19B is a longitudinal cross-sectional view of the wire crimping area Pa of the wire crimping device 400 and the area around the wire crimping area Pa during the wire inserting step.

Figure 20A:
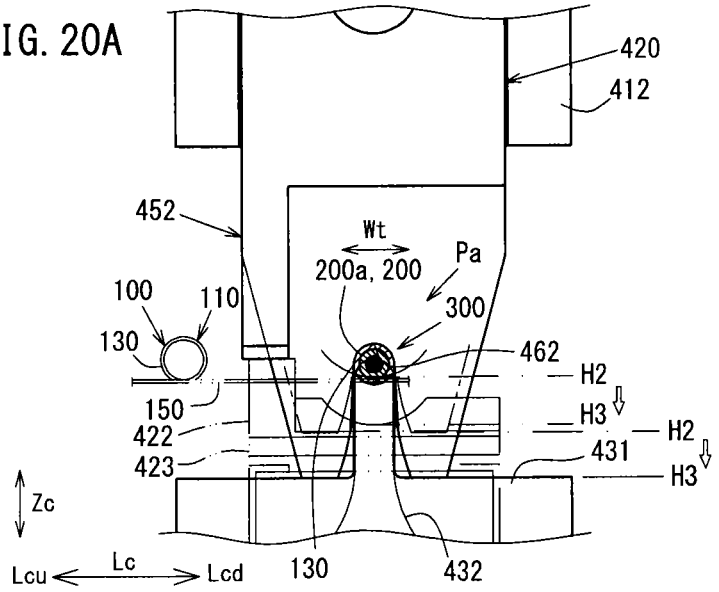
FIG. 20A and FIG. 20B are operational explanatory views of a wire crimping step.
Figure 20B:
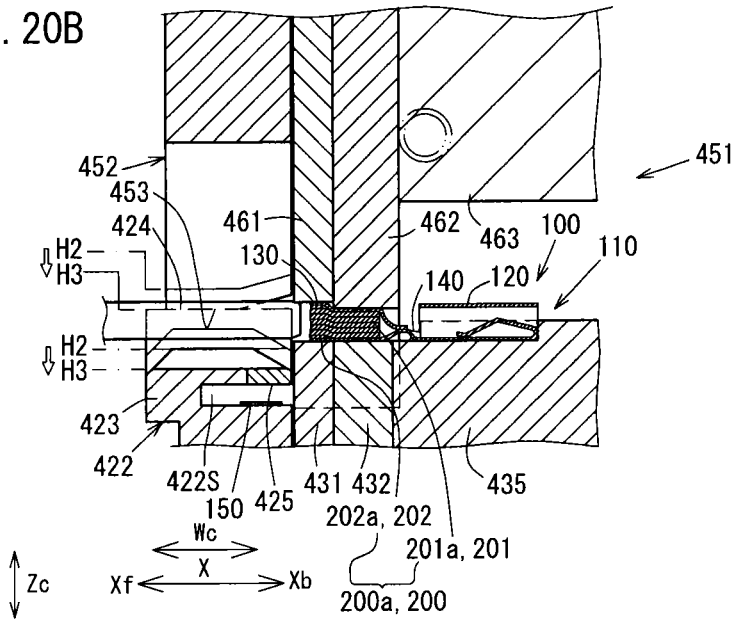

FIG. 20A and FIG. 20B are constitutional explanatory views of the anvil jig 421 and the crimper jig 451. FIG. 20A is a front view of the wire crimping area Pa of the wire crimping device 400 and an area around the wire crimping area Pa during a wire crimping step, and FIG. 20B is a longitudinal cross-sectional view of the wire crimping area Pa of the wire crimping device 400 and the area around the wire crimping area Pa during the wire crimping step.

The wire crimping device 400 according to this embodiment is a device which forms a crimp-terminal-equipped wire 210 in a following manner. That is, a terminal connection strip 100 is paid off from a reel not shown in the drawing so that a plurality of female crimp terminals 110 which are provided to the carrier 150 of the terminal connection strip 100 in a chained manner along a long length direction of the carrier 150 are supplied to the wire crimping area Pa where a crimping section 130 and a conductor 201 are crimped to each other from an upstream side Lcu intermittently. The female crimp terminal 110 is separated from the carrier 150 at the wire crimping area Pa. In the wire crimping area Pa, a conductor tip 201*a* of an insulated wire 200 is inserted into the inside of a crimping section 130 of the female crimp terminal 110 in the terminal connection strip 100 and, thereafter, the crimping section 130 of the female crimp terminal 110 and a distal end side of the insulated wire 200 are connected to each other by crimping thus forming the crimp-terminal-equipped wire 210.

In the following description, the long length direction of the carrier 150 is set as a carrier long length direction Lc, and a width direction of the carrier 150 is set as a carrier width direction Wc. Further, with respect to the long length direction of the carrier 150, a direction along which the carrier 150 is fed (carrier advancing direction) is set as a feeding direction downstream side Lcd, and a side opposite to the feeding direction downstream side Lcd is set as a feeding direction upstream side Lcu. A depth direction of the wire crimping device 400 is set as an X direction, a front side in the depth direction, that is, a carrier 150 side with respect to the female crimp terminal 110 in the terminal connection strip 100 is set as an Xf direction, and a rear side in the depth direction, that is, a female crimp terminal 110 side with respect to the carrier 150 in the terminal connection strip 100 is set as an Xb direction.

Further, a long length direction of the female crimp terminal 110 is set as a terminal axis direction Lt. The terminal axis direction Lt is the direction which agrees with a long length direction of an insulated wire 200 to which the crimping section 130 is connected by crimping and with the carrier width direction Wc as shown in FIG. 17B.

A width direction of the female crimp terminal 110 is set as a terminal width direction Wt. The terminal width direction Wt is, as shown in FIG. 17A, the direction which intersects the terminal axis direction Lt in a planar direction and agrees with the carrier long length direction Lc. Further, a box section 120 side with respect to the crimping section 130 in the terminal axis direction Lt is set as a front side Ltf (distal end side), while a crimping section 130 side with respect to the box section 120 is set as a rear side Ltb (proximal end side).

The insulated wire 200 which is connected to the female crimp terminal 110 has the constitution substantially similar to the constitution of the insulated wire 200 in the first embodiment.

For example, the conductor 201 is formed by stranding aluminum alloy wires such that a cross section of the conductor 201 is 0.75 $mm^2$.

Next, the constitution of the terminal connection strip 100 which is an object to be worked by the wire crimping device 400 is described.

The terminal connection strip 100 has the constitution substantially similar to the constitution of the terminal connection strip 100 in the above-mentioned first embodiment and is formed by blanking a copper alloy strip (not shown in the drawing) made of brass whose surface is tin-plated (Sn plated) or the like as a plate-shaped base material to integrally form the carrier 150 and female crimp terminals 110 using blanking not shown in the drawing.

Accordingly, as shown in FIG. 15 to FIG. 17C, the terminal connection strip 100 is integrally formed of the carrier 150 formed into a strip shape and the female crimp terminals 110 which project from one end side of the carrier 150 in the carrier width direction Wc.

In the carrier 150 in the second embodiment, when manufacturing the female crimp terminal 110, only a first positioning hole 161 which allows the insertion of a positioning pin not shown in the drawing which enables the positioning of the carrier 150 while the carrier 150 is fed toward the feeding direction downstream side Lcd is formed for each projection portion of the female crimp terminal 110.

The wire crimping section 131 has a hollow shape (cylindrical shape) where a distal end side (front side Ltf) thereof and whole peripheral surface portion are not opened and a wire insertion opening 130*s* which opens such that a wire tip 200*a* can be inserted through the wire insertion opening 130*s* is formed in the wire crimping section 131 on the rear side Ltb in the terminal axis direction.

Next, the constitution of the wire crimping device 400 in this embodiment is described in detail with respect to each part.

The wire crimping device 400 is, as shown in FIG. 15 and FIG. 16, formed of a crimping device body 400A and a wire inserting means 400B for inserting the wire into the wire insertion opening 130*s* of the crimping section 130 of the female crimp terminal 110 which is supplied to the wire crimping area Pa in the crimping device body 400A from the front Xf side of the crimping device body 400A.

The wire inserting means 400B is arranged on the front side Xf in the X direction with respect to the wire crimping area Pa and has a chuck 400Ba which holds the insulated wire 200 and a drive means not shown in the drawing which can advance toward the insertion direction (Xb) along which the insulated wire 200 is inserted into the inside of the crimping section 130 of the female crimp terminal 110 which is arranged at the wire crimping area Pa and can retract to the direction (Xf) opposite to the insertion direction.

The crimping device body 400A is formed of a base 410 and an ascending/descending body 420 which goes up and down in a Zc direction with respect to the base 410. The base 410 is formed of, mainly, a terminal conveyance rail 411, a carrier feeding mechanism 415, an ascending guide rail 412 and the anvil jig 421. The ascending/descending body 420 includes the crimper jig 451.

The terminal conveyance rail 411 is installed such that a conveyance path R through which the terminal connection strip 100 is conveyed to the right side (downstream side Lcd) from the left side (upstream side Lcu) in a state where the wire crimping device 400 is viewed from a front side. That is, the terminal conveyance rail 411 is horizontally placed in such a manner that the terminal conveyance rail 411 supports the terminal connection strip 100 which is paid off from the reel (not shown in the drawing) which is provided at an upstream side and can guide the terminal connection strip 100 along the conveyance path R to the wire crimping area Pa where the crimping section 130 and the insulated wire 200 are crimped to each other.

The carrier feeding mechanism 415 includes a swing arm 417 which is arranged on the upstream side Lcu of the ascending guide rail 412 in the wire crimping device 400 and is pivotally attached to a pivotally attached portion 416 in an upper portion of the base 410, a cam mechanism not shown in the drawing which swings the swing arm 417 in an interlocking manner with an ascending/descending motion of the ascending/descending body 420, and a feeding pawl 418 which is mounted on a distal end side of the swing arm 417 and feeds the terminal connection strip 100 toward the downstream side along with the swing of the swing arm 417.

By the operation of the carrier feeding mechanism 415, the feeding pawl 418 is engaged with each of first positioning holes 161 which are arranged at predetermined intervals along the long length direction Lc of the carrier 150 of the terminal connection strip 100 placed on the terminal conveyance rail 411 so that the female crimp terminals 110 are intermittently conveyed to the wire crimping area Pa.

The ascending guide rail 412 is a power transmitting means which transmits a drive force generated by a drive source not shown in the drawing to the ascending/descending body 420 such that the ascending guide rail 412 can guide the ascending/descending body 420 to slide in the vertical (Zc) direction.

The anvil jig 421 is, as shown in FIG. 16, arranged below the crimper jig 451 such that the anvil jig 421 faces the crimper jig 451 in an opposed manner at the wire crimping area Pa. The anvil jig 421 includes a shearing member 422, an insulation anvil 431, a wire anvil 432, and a lower-side terminal holding die 435 which are arranged in this order from the front side Xf to the rear side Xb along the depth direction of the wire crimping device 400.

In the anvil jig 421, the insulation anvil 431, the wire anvil 432, and the lower-side terminal holding die 435 are integrally fixed to the base 410 using bolts not shown in the drawing, while the shearing member 422 can ascend and descend with respect to the insulation anvil 431.

The shearing member 422 includes, as shown in FIG. 17A, a block-shaped shearing member body portion 423 and a punch receiving portion 24. Here, the punch receiving portion 24 projects into the wire crimping area Pa from one side portion in the width direction (carrier long length direction Lc) on the upper surface of the shearing member body portion 423 and receives a pressing force of a punching member 452 described later.

This will be described in more detail. The punch receiving portion 24 is arranged on one side portion of the shearing member 422 in the width direction (Lc) in such a manner that the punch receiving portion 24 does not face the wire insertion opening 130*s* of the crimping section 130 of the female crimp terminal 110 arranged in the wire crimping area Pa in the carrier long length direction Lc.

The shearing member body portion 423 is, as shown in FIG. 17B, arranged at a portion which corresponds to the conveyance path R of the carrier 150 in the depth direction X. In a state where the shearing member body portion 423 is arranged at a standby height H1 at which the shearing member body portion 423 stands by at a usual time when the shearing member body portion 423 does not cut the carrier 150, the shearing member body portion 423 is arranged such that an upper portion of the shearing member body portion 423 projects upward with respect to the conveyance path R. In the shearing member 422, to prevent the carrier 150 which is conveyed along the conveyance path R from interfering with the shearing member 422, a carrier insertion groove 422S formed by notching so that the carrier 150 can be inserted into the carrier insertion groove 422S is formed at a portion corresponding to a portion where the carrier 150 passes in an upper portion of the shearing member 422.

That is, the carrier insertion groove 422S is formed in an upper portion of the shearing member 422 with a gap larger than a thickness of the carrier 150, and has a groove shape formed by horizontally notching the shearing member 422 over the whole width direction (carrier long length direction Lc) from an end portion of the rear side Xb in the depth direction to the front side Xf in the depth direction.

The shearing member 422 is arranged such that an opening edge portion of the carrier insertion groove 422S faces a connection portion 151 of the terminal connection strip 100 in an opposed manner at the standby height H1. A shearing blade 425 to shear the connection portion 151 is formed on an upper side portion of the opening edge portion of the carrier insertion groove 422S.

This will be described in more detail. The shearing member 422 is arranged such that, in a standby state, as described above, the shearing blade 425 is positioned above the connection portion 151 and hence, the shearing member body portion 423 is arranged in a state where the upper portion of the shearing member body portion 423 projects above the conveyance path R. That is, the shearing member 422 is arranged in a state where at least a portion of the shearing member body portion 423 above the carrier insertion groove 422S in the vertical direction overlaps with the wire insertion opening 130*s* of the crimping section 130 which is supplied to the wire crimping area Pa (see FIG. 17A to FIG. 17C).

Further, the shearing member 422 can be lowered from the standby height H1 to a shearing completion height H2 (see FIG. 18A and FIG. 18B) which is a position at which the shearing of the carrier 150 is completed.

As shown in FIG. 18A and FIG. 18B, in a state where the shearing member 422 is lowered to the shearing completion height H2, the shearing member body portion 423 can be lowered to a position where the shearing member body portion 423 does not overlap with the wire insertion opening 130*s* of the crimping section 130 of the female crimp terminal 110 which is arranged at the wire crimping area Pa.

Further, as shown in FIG. 16, the shearing member 422 includes an biasing spring 426 which biases the shearing member 422 toward a direction along which the shearing member 422 which has been lowered to a position lower than the shearing completion height H2 ascends, and the shearing member 422 is biased by the biasing spring 426 in the usual time so that the shearing member 422 stays at the standby height H1.

Further, the above-mentioned insulation anvil 431 can hold the female crimp terminal 110 in the terminal connection strip 100 which is supplied to the wire crimping area Pa, particularly, a cover crimping section 131*a*, from below and is arranged such that the insulation anvil 431, together with an insulation crimper 461 described later, can crimp the cover crimping section 131*a*.

The wire anvil 432 can hold the female crimp terminal 110 in the terminal connection strip 100 which is supplied to the wire crimping area Pa, particularly, a conductor crimping section 131*b*, from below and is arranged such that the wire anvil 432, together with a wire crimper 462 described later, can crimp the conductor crimping section 131*b*.

The lower-side terminal holding die 435 is arranged below the female crimp terminal 110 in the terminal connection strip 100 supplied to the wire crimping area Pa and can hold a box section 120 mainly in the female crimp terminal 110 in such a manner that the box section 120 is sandwiched by the lower-side terminal holding die 435 and an upper-side terminal holding die 463 described later from both upper and lower sides.

Next, the ascending/descending body 420 is described.

The ascending/descending body 420 is arranged above the wire crimping area Pa and is elevatable at least three stages by a drive control of a servomotor. That is, the ascending/descending body 420 can stop at any one of at least three positions consisting of a standby height H1 (see FIG. 17A to FIG. 17C) at which the ascending/descending body 420 is away from the female crimp terminal 110 arranged in the wire crimping area Pa, a shearing completion height H2 (see FIG. 18A and FIG. 18B and FIG. 19A and FIG. 19B) at which the shearing of the female crimp terminal 110 and the carrier 150 arranged at the wire crimping area Pa is completed, and the crimping completion height H3 (FIG. 20A and FIG. 20B) at which the wire tip 200*a* can be crimped.

The crimper jig 451 is mounted on a lower part of the ascending/descending body 420, that is, a distal end portion on a side where the ascending/descending body 420 faces the anvil jig 421 in an opposed manner.

The crimper jig 451 is, as shown in FIG. 16, arranged in a state where the crimper jig 451 faces the anvil jig 421 in the wire crimping area Pa in an opposed manner. The crimper jig 451 includes the punching member 452, the insulation crimper 461, the wire crimper 462, and the upper-side terminal holding die 463 which are arranged in this order from the front side Xf to the rear side Xb in the depth direction of the wire crimping device 400.

The punching member 452 includes a punching projecting portion 453 which presses and thereby lowers the shearing member 422 together with the punching projecting portion 453 along with descending of the ascending/descending body 420.

The punching projecting portion 453 is, as shown in FIG. 17A, formed at one end side of a lower surface of the punching member 452 in the width direction. That is, the punching projecting portion 453 is formed on a portion of the punching member 452 on a side where the punching projecting portion 453 faces the punch receiving portion 24 in the above-described shearing member 422 in an opposed manner in such a manner that the punching projecting portion 453 projects downward toward the punch receiving portion 24.

The insulation crimper 461 is arranged such that the insulation crimper 461 can, together with the insulation anvil 431, crimp the female crimp terminal 110 of the terminal connection strip 100 supplied to the wire crimping area Pa, particularly, a cover crimping section 131*a* of the female crimp terminal 110.

The wire crimper 462 is arranged such that the wire crimper 462 can, together with the wire anvil 432, crimp the female crimp terminal 110 of the terminal connection strip 100 supplied to the wire crimping area Pa, particularly, a conductor crimping section 131*b* of the female crimp terminal 110.

Next, a manufacturing method for manufacturing a crimp-terminal-equipped wire 210 using the above-mentioned wire crimping device 400 is described. The female crimp terminal 110 and the carrier 150 in the terminal connection strip 100 which are arranged at the wire crimping area Pa are separated from each other, the crimping section 130 of the female crimp terminal 110 is crimped to a distal end side of the insulated wire 200 so that the female crimp terminal 110 and the insulated wire 200 are connected to each other whereby the crimp-terminal-equipped wire 210 is manufactured.

In the manufacturing method of the crimp-terminal-equipped wire 210, a carrier cutting step, a wire inserting step and a wire crimping step are performed in this order.

The terminal connection strip 100 is conveyed to the downstream side Lcd on the terminal conveyance rail 411 along the carrier long length direction Lc. The female crimp terminals 110 in the terminal connection strip 100 are intermittently arranged at the wire crimping area Pa. At that time, the terminal connection strip 100 is conveyed along the conveyance path R in a posture where the wire insertion opening 130*s* of the crimping section 130 in the female crimp terminal 110 is directed to the front side Xf in the depth direction.

Further, the female crimp terminal 110 which is supplied to the wire crimping area Pa is arranged in a state where the female crimp terminal 110 is supported on the insulation anvil 431, the wire anvil 432 and lower-side terminal holding die 435 in the anvil jig 421. On the other hand, the carrier 150 is arranged at the wire crimping area Pa in a state where a portion of the carrier 150 positioned at the wire crimping area Pa in the carrier long length direction Lc is inserted into the carrier insertion groove 422S formed in the shearing member 422.

In the carrier cutting step, as shown in FIG. 17A and FIG. 17B, in a state where the female crimp terminal 110 is arranged at the wire crimping area Pa, the ascending/descending body 420 is lowered from the standby height H1 while being guided by the terminal conveyance rail 411. Along with the descending of the ascending/descending body 420, the crimper jig 451 is lowered together with the ascending/descending body 420, and the punching projecting portion 453 of the punching member 452 in the crimper jig 451 is brought into contact with the punch receiving portion 24 of the shearing member 422. In this state, the ascending/descending body 420 is further lowered, and along with the descending of ascending/descending body 420, the ascending/descending body 420 lowers only the shearing member 422 in the anvil jig 421.

Accordingly, a portion of the carrier 150 which is inserted into the carrier insertion groove 422S formed in the shearing member 422 is lowered together with the shearing member 422 and hence, the shearing blade 425 of the shearing member 422 and the insulation anvil 431 shear a connection portion 151 from a state shown in FIG. 17A to FIG. 17C in cooperation. By the time when the shearing member 422 arrives at the shearing completion height H2, as shown in FIG. 18A and FIG. 18B, the terminal connection strip 100 is surely separated into the carrier 150 and the female crimp terminal 110.

In a state where the shearing member 422 has arrived at the shearing completion height H2 where the shearing of the connection portion 151 by the shearing member 422 is completed, the wire inserting step is performed.

In the wire inserting step, in a state that the shearing member 422 is, as shown in FIG. 18A and FIG. 18B, arranged at the shearing completion height H2, as shown in FIG. 19A and FIG. 19B, the wire tip 200*a* is inserted into the wire insertion opening 130*s* formed in the crimping section 130 in the female crimp terminal 110 which is arranged at the wire crimping area Pa from the front side Xf in the device depth direction X by linear motion generated by the wire inserting means 400B.

That is, as shown in FIG. 18A and FIG. 18B and FIG. 19A and FIG. 19B, in a state where the shearing member 422 is arranged at the shearing completion height H2, the shearing member body portion 423 is arranged at a position below the conveyance path R, that is, a position at which the shearing member body portion 423 does not overlap with the wire insertion opening 130*s* in the vertical direction (see FIG. 18A and FIG. 18B) and hence, as shown in FIG. 19A and FIG. 19B, the wire tip 200*a* can be smoothly inserted into the inside of the crimping section 130 through the wire insertion opening 130*s* while avoiding the interference with the shearing member 422.

In the wire crimping step, as shown in FIG. 19A and FIG. 19B, in a state where the wire tip 200*a* is inserted into the wire crimping section 131 in the crimping section 130, the crimper jig 451 is lowered to the crimping completion height H3 which is further lower than the above-mentioned shearing completion height H2 with respect to the anvil jig 421 whereby, as shown in FIG. 20A and FIG. 20B, the crimper jig 451 can press the wire crimping section 131 and hence, the wire crimping section 131 can be connected to the wire tip 200*a* by crimping.

After the crimping of the wire tip 200*a* and the crimping section 130 is completed, the ascending/descending body 420 is ascended. Along with the ascending of the ascending/descending body 420, a pressing force of the punching member 452 to the shearing member 422 is released. Since the shearing member 422 is biased upward by the biasing spring 426 (see FIG. 16), the shearing member 422 is ascended to the standby height H1. The shearing member 422 stands by for the next female crimp terminal 110 to be supplied to the wire crimping area Pa at the standby height H1.

The terminal connection strip 100 is conveyed to the downstream side Lcd of the terminal conveyance rail 411 along the carrier long length direction Lc by a predetermined pitch by the feeding pawl 418.

The crimp-terminal-equipped wire 210 can be manufactured by the above-mentioned wire crimping method. The manner of operation and advantageous effects obtained by the above-mentioned wire crimping device 400 and the manufacturing method of the crimp-terminal-equipped wire 210 are described.

According to the above-mentioned wire crimping method, in the carrier cutting step, the shearing member 422 is lowered to the shearing completion height H2 from the standby height H1. While the shearing member 422 is arranged at the shearing completion height H2, the wire inserting step is performed by the wire inserting means 400B. Accordingly, in the wire inserting step, there is no possibility that the wire tip 200*a* and the shearing member 422 interfere with each other and hence, the wire tip 200*a* can be surely inserted into the crimping section 130 through the wire insertion opening 130*s*.

That is, on the front side Xf in the device depth direction X, a space where the wire tip 200*a* can be inserted into the wire insertion opening 130*s* can be ensured while preventing the shearing member 422 from facing the wire insertion opening 130*s* in an opposed manner. Accordingly, even when an outer diameter of the wire tip 200*a* is slightly smaller than an inner diameter of the wire insertion opening 130*s*, in inserting the wire tip 200*a* into the inside of the crimping section 130 through the wire insertion opening 130*s*, the wire tip 200*a* does not interfere with the shearing member 422 so that the wire tip 200*a* can be smoothly and surely inserted into the crimping section 130.

Accordingly, the hollow crimping section 130 in the closed-barrel-type female crimp terminal 110 and the wire tip 200*a* which is inserted into the crimping section 130 can be surely and efficiently crimped to each other.

This will be described in more detail. In the conventional connection method of a closed-barrel-type crimp terminal, the closed-barrel-type crimp terminal is individually manufactured one by one by using brazing, casting or the like. Accordingly, when the closed-barrel-type crimp terminal and an insulated wire 200 are connected to each other, a female crimp terminal 110 is individually set to a crimping jig and is crimped to a wire tip 200*a* of the insulated wire 200 and hence, the conventional method has a drawback that the manufacturing efficiency is low.

In contrast, according to the wire crimping device 400 and the wire crimping method of this embodiment, the carrier cutting step is performed immediately before the wire inserting step. The wire inserting step is performed in a state where the shearing member 422 is lowered to the shearing completion height H2 at which the shearing member 422 does not overlap with the wire insertion opening 130*s* formed in the crimping section 130 in the female crimp terminal 110 arranged at the wire crimping area Pa and hence, the strip-like terminal connection strip 100 is conveyed and is sequentially supplied to the wire crimping area Pa. At the wire crimping area Pa, the terminal connection strip 100 is separated into the carrier 150 and the female crimp terminal 110. Accordingly, even the female crimp terminal 110 is a closed-barrel-type female crimp terminal 110, the wire tip 200*a* can be surely inserted into the hollow crimping section 130 and the wire tip 200*a* and the crimping section 130 can be crimped to each other.

According to the wire crimping device 400 and the wire crimping method of this embodiment, a series of respective steps applied to the terminal connection strip 100, that is, the carrier cutting step, the wire inserting step and the wire crimping step can be continuously performed with accuracy at the wire crimping area Pa without moving the female crimp terminal 110 between the respective steps.

Accordingly, the irregularity which may occur when the female crimp terminal 110 is moved between the respective steps can be prevented and, further, the crimp-terminal-equipped wire 210 formed by connecting the closed-barrel-type female crimp terminal 110 and the insulated wire 200 to each other can be continuously manufactured thus realizing the mass production of the high-quality crimp-terminal-equipped wire 210.

Further, the wire crimping device 400 according to this embodiment includes the lower-side terminal holding die 435 and upper-side terminal holding die 463 which hold the female crimp terminal 110.

Due to the above-mentioned constitution, in a state where the female crimp terminal 110 is held by at least the lower-side terminal holding die 435 out of the lower-side terminal holding die 435 and the upper-side terminal holding die 463, for example, the female crimp terminal 110 can be separated from the carrier 150, the wire tip 200*a* can be inserted into the inside of the crimping section 130 through the wire insertion opening 130*s* which is opened toward the carrier 150 side in the terminal axis direction Lt of the crimping section 130, and the crimping section 130 and the wire tip 200*a* inserted into the crimping section 130 can be crimped to each other. In performing these steps, there is no possibility that the female crimp terminal 110 arranged at the wire crimping area Pa is inadvertently positionally displaced. Accordingly, these series of steps can be stably and continuously performed and hence, the high-quality crimp-terminal-equipped wire 210 formed by connecting the closed-barrel-type female crimp terminal 110 and the insulated wire 200 to each other can be efficiently manufactured.

Further, in the above-mentioned manufacturing method of the crimp-terminal-equipped wire 210, the crimp-terminal-equipped wire 210 is manufactured while paying off the terminal connection strip 100 provided with the closed-barrel-type female crimp terminals 110 each having the hollow crimping section 130 from a reel not shown in the drawing. However, the manufacturing method is not limited to such a method. For example, it may be possible to use a terminal connection strip provided with female crimp terminals 110 where each terminal is in a developed shape immediately after being blanked from the plate-shaped base material. Then, a bending step, a welding step and a sealing portion forming step may be appropriately applied to the female crimp terminals 110 of the terminal connection strip and, thereafter, a carrier cutting step, a wire inserting step, and a wire crimping step may be continuously performed.

In the above-mentioned embodiment, the crimp-terminal-equipped wire 210 is manufactured using the terminal connection strip 100. Next, another embodiment, that is, the embodiment which differs in manufacturing method from the above-mentioned embodiment is described by reference to FIG. 21A to FIG. 23B.

Here, the constitutions identical with the constitutions of the above-mentioned embodiment are given the same symbols, and the description of such constitutions is omitted.

Figure 21A:
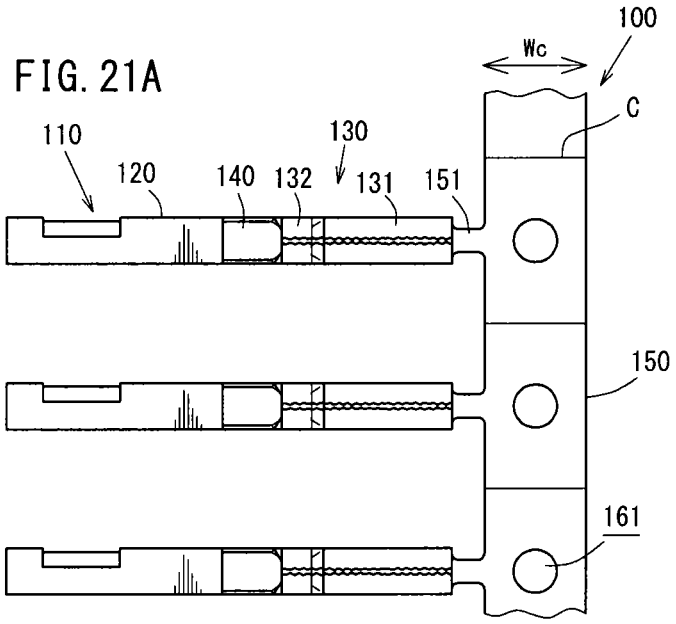
FIG. 21A and FIG. 21B are explanatory views of another wire crimping method of the second embodiment.
Figure 23A:
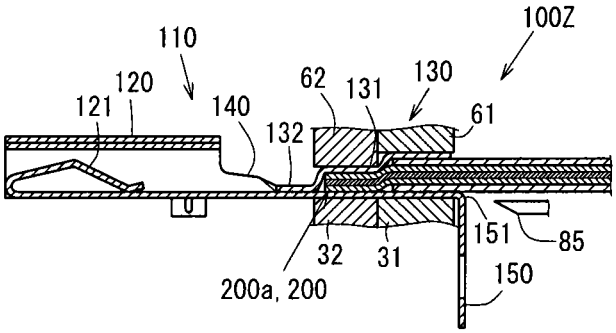
FIG. 23A and FIG. 23B are explanatory views of the other wire crimping method of the second embodiment.
Figure 23B:
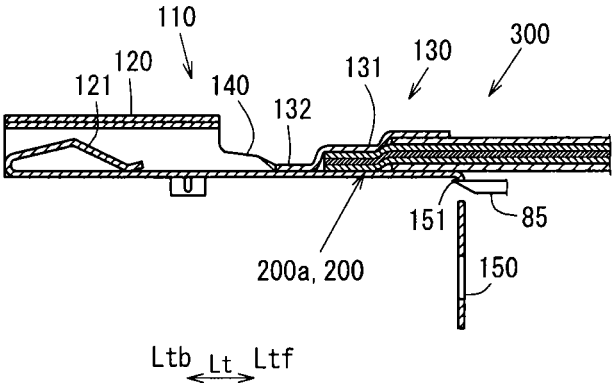

FIG. 21A to FIG. 23B are explanatory views of a terminal connection strip separating step in the manufacturing method according to another embodiment. This will be described in more detail. FIG. 21A is a plan view of the terminal connection strip 100 showing a portion thereof in the carrier long length direction Lc. FIG. 21B is a plan view of a carrier-equipped terminal 100Z showing a mode where the carrier-equipped terminal 100Z is cut from the terminal connection strip 100 by the terminal connection strip separating step. FIG. 22A1 and FIG. 22A2 are a longitudinal cross-sectional view and a plan view respectively showing the carrier-equipped terminal 100Z for describing a connection portion bending step where a connection portion 151 is bent such that an angle formed between a carrier 150 and a female crimp terminal 110 becomes an approximately right angle. FIG. 22B1 and FIG. 22B2 are a longitudinal cross-sectional view and a plan view respectively showing the carrier-equipped terminal 100Z for describing a wire inserting step where a wire tip 200*a* is inserted into the inside of a crimping section 130 through a wire insertion opening 130*s*. FIG. 23A is a longitudinal cross-sectional view of the carrier-equipped terminal 100Z for describing a wire crimping step, and FIG. 23B is a longitudinal cross-sectional view of the carrier-equipped terminal 100Z for describing a connection portion cutting step.

In the wire crimping method according to another embodiment, that is, in the manufacturing method of the crimp-terminal-equipped wire 210, a terminal connection strip separating step, a connection portion bending step, a wire inserting step, a wire crimping step, and a connection portion cutting step are performed in this order.

Figure 21B:
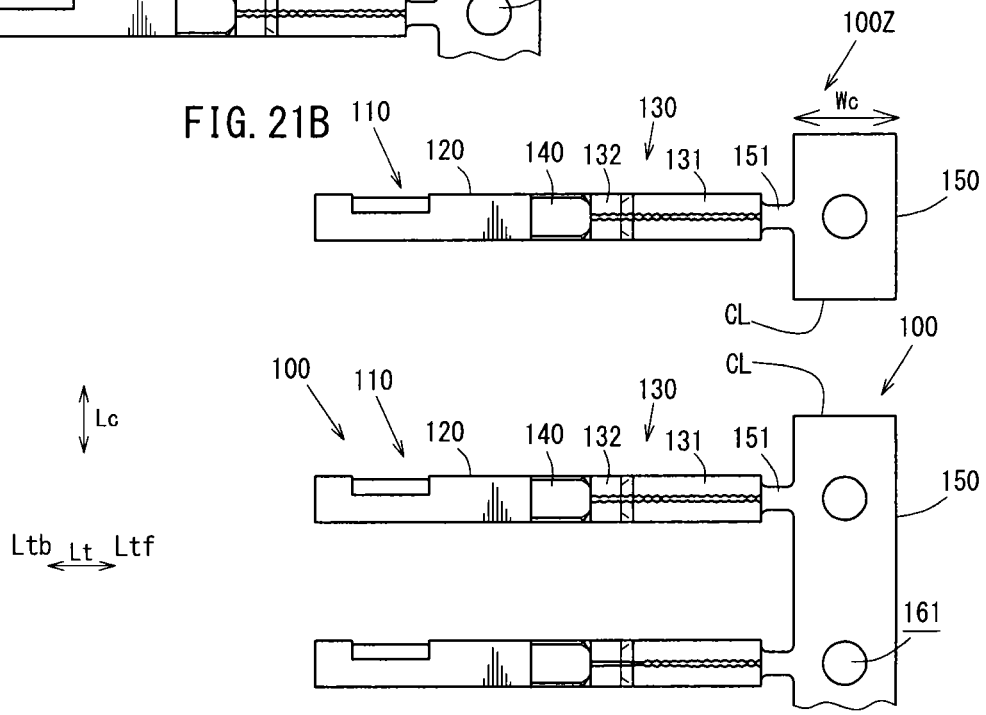

In the terminal connection strip separating step, the carrier 150 in the terminal connection strip 100 is cut into pieces by a carrier cutting blade not shown in the drawing along a cutting line C shown in FIG. 21A for every portion corresponding to a portion between the female crimp terminals 110 in the carrier long length direction Lc. Accordingly, as shown in FIG. 21B, a carrier-equipped terminal 100Z where one female crimp terminal 110 is provided to each cut piece of the carrier 150 is formed.

In the connection portion bending step, as shown in FIG. 22A1 and FIG. 22A2, a connection portion 151 is bent at approximately 90 degrees toward a direction along which the carrier 150 does not close a wire insertion opening 130*s*. That is, the connection portion 151 is brought into a state where an angle formed between the female crimp terminal 110 and the carrier 150 becomes an approximately right angle from a state where a bottom surface of the female crimp terminal 110 and the carrier 150 are positioned on the same plane.

In the wire inserting step, as shown in FIG. 22B1 and FIG. 22B2, from a state where a wire tip 200*a* is arranged such that the wire tip 200*a* faces the wire insertion opening 130*s* in an opposed manner, the wire tip 200*a* is inserted into the crimping section 130 through the wire insertion opening 130*s*.

In the wire crimping step, as shown in FIG. 23A, in a state where the wire tip 200*a* is inserted into the inside of the crimping section 130, in the same manner as the wire crimping step in the previously-mentioned embodiment, the wire crimper 462 and the insulation crimper 461 are lowered toward the wire anvil 432 and the insulation anvil 431 so that the wire crimping section 131 and the wire tip 200*a* are crimped to each other in a state where the wire crimper 462 and the insulation crimper 461 clamp the wire crimping section 131 and the wire tip 200*a* with the wire anvil 432 and the insulation anvil 431.

In the connection portion cutting step, as shown in FIG. 23B, the connection portion 151 is cut by a connection portion cutting blade 485 arranged to face the connection portion 151 in an opposed manner thus separating the carrier-equipped terminal 100Z into the crimp-terminal-equipped wire 210 and the carrier 150.

In the manufacturing method according to the above-mentioned embodiment, in the connection portion cutting step, the connection portion cutting blade 485 cuts the connection portion 151 from a state where the connection portion cutting blade 485 is arranged to face the connection portion 151 which is bent toward a direction along which the connection portion 151 is away from the female crimp terminal 110 in an opposed manner. Accordingly, the connection portion cutting blade 485 can be arranged such that the connection portion cutting blade 485 does not project to the wire insertion opening 130*s* side and does not overlap with the wire insertion opening 130*s*.

Accordingly, in the wire inserting step, there is no possibility that the wire tip 200*a* and the connection portion cutting blade 485 interfere with each other and hence, the wire tip 200*a* can be smoothly and surely inserted into the inside of the crimping section 130 through the wire insertion opening 130*s*.

Further, in the connection portion cutting step, even in a state where the wire tip 200*a* and the crimping section 130 are crimped to each other, the connection portion cutting blade 485 can smoothly and surely cut the connection portion 151 without being interfered by the insulated wire 200 and without damaging the insulated wire 200.

According to the wire crimping device and the wire crimping method of the above-mentioned another embodiment, a series of steps consisting of the terminal connection strip separating step, the connection portion bending step, the wire inserting step, the wire crimping step and the connection portion cutting step can be continuously and accurately performed on the terminal connection strip 100.

Accordingly, the crimp-terminal-equipped wire 210 formed by connecting the closed-barrel-type female crimp terminal 110 and the insulated wire 200 to each other can be continuously manufactured thus realizing the mass production of the crimp-terminal-equipped wires 210.

Further, the wire crimping device of the another embodiment may be also provided with a terminal holding means which holds the female crimp terminal 110 during a period where at least any one of steps among the terminal connection strip separating step, the connection portion bending step, the wire inserting step, the wire crimping step and the connection portion cutting step is performed.

In the above-mentioned terminal connection strip separating step, the carrier-equipped terminal 100Z where one female crimp terminal 110 is provided to the cut piece of the carrier 150 is cut from the terminal connection strip 100. However, the constitution is not limited to such a constitution, and carrier-equipped terminals 100Z where two or more female crimp terminals 110 are provided to the cut piece of the carrier 150 may be cut from the terminal connection strip 100. The connection portion bending step and the succeeding steps may be performed on such carrier-equipped terminals 100Z.

Further, in the manufacturing method according to another embodiment, it is not always necessary to perform the terminal connection strip separating step, the connection portion bending step, the wire inserting step, the wire crimping step, and the connection portion cutting step in this order. For example, at least two steps out of these steps may be performed simultaneously, or the connection portion cutting step may be performed before the wire inserting step.

Further, the cutting of the carrier 150 in the terminal connection strip separating step is not always limited to the cutting using the carrier cutting blade. In the same manner, the cutting of the connection portion 151 in the connection portion cutting step is not always limited to the cutting using the connection portion cutting blade 485. For example, the connection portion 151 may be cut by melting using a laser beam or electricity.

Preferably, for cutting the cutting portion, a fiber laser beam is emitted to the cutting portion from a fiber laser beam emitting device.

Compared to other laser welding, an extremely small spot can be set as a focal point in the fiber laser welding and hence, it is possible to realize laser welding with high output and, at the same time, a laser beam can be emitted in a continuous manner.

Accordingly, by performing the cutting of the cutting portion using the fiber laser beam in this manner, the cutting portion can be cut smoothly in a favorable cutting state.

In the above-mentioned embodiment, the crimp terminal is formed of the female crimp terminal 110 constituted of the box section 120 and the crimping section 130. However, provided that the crimp terminal includes the crimping section 130, the crimp terminal may be a male crimp terminal (not shown in the drawing) formed of an insertion tab to be inserted into and connected to the box section 120 of the above-mentioned female crimp terminal 110 and the crimping section 130, or a crimp terminal formed of only the crimping section 130 and to which conductors 201 of a plurality of insulated wires 200 in a bundle are connected.

In the above-mentioned embodiment, the female crimp terminal 110 and the carrier 150 are connected to each other by way of the connection portion 151. The place where the connection portion 151 is formed on is not limited to a lower end portion of the peripheral edge portion of the wire insertion opening 130*s*. The connection portion 151 may be formed on an upper end portion of the peripheral edge portion of the wire insertion opening 130*s* of the crimping section 130 or other portions.

In the above-mentioned description, the lower-side terminal holding die 435 is provided to the anvil jig 421 and the upper-side terminal holding die 463 is provided to the crimper jig 451, and the female crimp terminal 110 is held in such a manner that particularly the box section 120 of the female crimp terminal 110 is held in a state where the lower-side terminal holding die 435 and the upper-side terminal holding die 463 clamp the box section 120 from the lower and upper sides. While holding the female crimp terminal 110 in such a state, the female crimp terminal 110 is separated from the carrier 150, the wire tip 200*a* is inserted into the inside of the crimping section 130 through the wire insertion opening 130*s* that opens toward the carrier 150 side in the terminal axis direction Lt of the crimping section 130, and the crimping section 130 and the wire tip 200*a* inserted into the crimping section 130 can be crimped to each other. However, even when the lower-side terminal holding die 435 and the upper-side terminal holding die 463 are not provided, the female crimp terminal 110 can be held by clamping the crimping section 130 by the anvil jig 421 and the crimper jig 451 in a state where the crimping section 130 of the female crimp terminal 110 is not crimped or by crimping the crimping section 130 of the female crimp terminal 110 to an extent that the wire can be inserted. In such a state where the female crimp terminal 110 is held in this manner, the female crimp terminal 110 may be separated from the carrier 150, or the wire tip 200*a* may be inserted into the inside of the crimping section 130 through the wire insertion opening 130*s* which opens toward the carrier 150 side in the terminal axis direction Lt of the crimping section 130.

This will be described in more detail. In the carrier cutting step, in a state where the female crimp terminal 110 is arranged at the wire crimping area Pa, along with the descending of the ascending/descending body 420 from the standby height H1, the crimper jig 451 is lowered to a position where the female crimp terminal 110 is held by being clamped from above and below in the vertical direction. That is, the crimping section 130 of the female crimp terminal 110 which is placed on the anvil jig 421 is clamped by the groove portions of the insulation crimper 461 and the wire crimper 462 of the crimper jig 451 having an approximately inverted V-shape as viewed in a front side and the insulation anvil 431 and the wire anvil 432 of the anvil jig 421 from above and below in the vertical direction. The position to which the crimper jig 451 is lowered is the position where the crimping section 130 of the female crimp terminal 110 is clamped in a clamping state where the crimping section 130 is not crimped or in a crimping state where the insertion of the wire is allowed, that is, the position higher than the crimping state which brings the crimping section 130 into a final crimping state where the conduction between the crimping section 130 and the wire tip 202*a* can be ensured.

In this state, only the shearing member 422 of the anvil jig 421 is lowered to the shearing completion height H2 so as to shear the connection portion 151 by the shearing member 422 and hence, the female crimp terminal 110 is separated from the carrier 150. Then, the wire inserting step is performed in this state.

In this manner, by controlling the descending height of the crimper jig 451 with respect to the anvil jig 421, even when the lower-side terminal holding die 435 and the upper-side terminal holding die 463 which clamp from below and above and hold the box section 120 of the female crimp terminal 110 are not provided, there is no possibility that the female crimp terminal 110 arranged at the wire crimping area Pa is inadvertently positionally displaced so that the carrier cutting step and the wire inserting step can be performed.

To describe the correspondence between the configuration of this disclosure and the configuration of the embodiment, they are as follows.

The crimp terminal of this invention corresponds to the female crimp terminal 110 of the embodiment.

In the same manner, the long length direction of this disclosure corresponds to the terminal long length direction Lt, the width direction of this disclosure corresponds to the terminal width direction Wt, the positioning hole 160 formed into a hole shape different from a hole shape of other positioning holes of this disclosure corresponds to the different-shaped first positioning hole 161*s* described later, the connecting portion of this disclosure corresponds to the connection portion 151, the wire connection structural body of this disclosure corresponds to the crimp-terminal-equipped wire 210, the carrier cutting means of this disclosure corresponds to the shearing member body portion 423 (shearing member 422), the crimping means of this disclosure corresponds to the insulation anvil 431 and the insulation crimper 461 as well as the wire anvil 432 and the wire crimper 462, the terminal holding means of this disclosure corresponds to at least the lower-side terminal holding die 435 from the lower-side terminal holding die 435 and the upper-side terminal holding die 463, the carrier thickness direction of this disclosure corresponds to the vertical direction, the side of the carrier opposite to the side to which the crimping section is provided of this disclosure corresponds to the lower side of the carrier, the standby position of this disclosure corresponds to the standby height H1, and the cutting position of this disclosure corresponds to the shearing completion height H2.

However, this invention is not limited to the configuration of the above-mentioned embodiments, and the application can be made based on technical concept called for in claims, and this invention can take various embodiments.

DESCRIPTION OF REFERENCE SIGNS

100, 100A to 100C, 100Pa to 100Pc: Terminal connection strip
110: Female crimp terminal
110A to 110D, 110Pa to 110Pc: Terminal fitting
130, 130A to 130D: Crimping section (Crimping base material)
130*s*: Wire insertion opening
130*t*: Opposedly-facing edge portion
130*z*: Barrel member
141: Welded portion
150: Carrier
150F: Carrier surface
160: Positioning hole
161: First positioning hole
161*s*: Different-shaped first positioning hole
161*a*: Center of perfect circle
162: Second positioning hole
151: Connection portion
200: Insulated wire
200*a*: Wire tip
201: Conductor
202: Insulating cover
400: Wire crimping device
400B: Wire inserting means
422: Shearing member
431: Insulation anvil
432: Wire anvil
435: Lower side terminal holding die
461: Insulation crimper
462: Wire crimper
463: Upper side terminal holding die
L: Fiber laser beam
CL2: Center axis of carrier in width direction
CL1: On terminal center axis in terminal width direction
H1: Standby height
H2: Shearing completion height
Lt: Terminal long length direction
Wt: Terminal width direction
Lc: Carrier long length direction
Lt: Terminal axis direction

The invention claimed is:

1. A terminal connection strip comprising:

a carrier formed in a strip shape; and a plurality of terminal fittings which project from at least one edge side of the carrier in a width direction, wherein each of the terminal fittings includes a crimping section which connects by crimping at least a conductor tip of an insulated wire provided with the conductor tip where a conductor is exposed by peeling off an insulating cover on a distal end side of the insulated wire to the terminal fitting, the crimping section includes a wire crimping section and a sealing portion, and the wire crimping section is formed into a hollow shape which allows the insertion of at least the conductor tip from a proximal end side of the crimping section and allows the wire crimping section to surround the conductor tip, the proximal end side of the crimping section and the carrier are connected to each other by way of a connection portion and have bottom surfaces thereof formed in common, the crimping section is formed such that a crimping base material which corresponds to the crimping section of the terminal fitting is bent around an axis of the terminal fitting, a first welded portion which is formed by welding opposedly-facing edge portions which face each other in an opposed manner along a terminal long length direction, at least a proximal end side of the first welded portion in the terminal long length direction is formed at a place which is not disposed on the same plane as a carrier surface of the carrier in a circumferential direction of the crimping section, and the sealing portion of the crimping section is formed by depressing an end portion of the crimping section in front of the wire crimping section such that predetermined portions of the terminal fitting overlap with each other in the circumferential direction, and by welding the end portion of the crimping section in the width direction such that a second welded portion is formed in the end portion of the crimping section.

2. The terminal connection strip according to claim 1, wherein at least the proximal end side of the first welded portion in the terminal long length direction is formed at the place which is not disposed on the same plane as the carrier surface of the carrier in the circumferential direction of the crimping section, and the first welded portion is arranged to be away upward from the carrier surface by an amount corresponding to a height of the crimping section.

3. The terminal connection strip according to claim 1, wherein the connection portion is formed with a width which is 1/16 or more and 1/4 or less of an outer peripheral length of the crimping section.

4. The terminal connection strip according to claim 1, wherein a positioning hole which allows the insertion of a positioning pin which positions the carrier is arranged for every connection portion which connects the terminal fitting to the carrier in the long length direction.

5. The terminal connection strip according to claim 4, wherein out of the positioning hole provided in plural, a positioning hole for every predetermined number of terminal fittings is formed into a hole shape different from a hole shape of other positioning holes.

6. A method of manufacturing a terminal connection strip comprising:

a blanking step where a terminal connection strip which is formed of a carrier formed in a strip shape and a plurality of terminal fittings which project from at least one edge side of the carrier in a width direction is blanked from a base material;

a bending step in which each of the terminal fittings is formed into a stereoscopic shape by bending the terminal fitting in a planar shape; and a welding step in which a crimping base material of the terminal fitting which corresponds to a crimping section which connects by crimping at least a conductor tip of an insulated wire provided with the conductor tip formed by exposing a conductor by peeling off an insulating cover on a distal end side of the insulated wire is bent about an axis of the terminal fitting, and opposedly-facing edge portions of the crimping base material are welded to each other, the crimping section including a wire crimping section and a sealing portion, wherein the blanking step, the bending step, and the welding step are performed in that order, a cylindrical bending step is performed in the bending step such that a crimping-section corresponding portion of the crimping base material is bent into a cylindrical shape where the opposedly-facing edge portions which face each other in a circumferential direction of the crimping base material face each other in an opposed manner at a position which is not disposed on the same plane as a carrier surface of the carrier so that at least the conductor tip is insertable into the crimping section from a proximal end side of the crimping section and is configured to be surrounded by the crimping section, a long-length-direction welding step is performed in the welding step such that the opposedly-facing edge portions are welded by a laser along a long length direction of the crimping base material from a position away from the opposedly-facing edge portions of the crimping base material by a distance which falls within a welding allowable threshold value by a laser beam, and the method further comprising depressing an end portion of the crimping section in front of the wire crimping section such that predetermined portions of the terminal fitting overlap with each other in the circumferential direction and the sealing portion of the crimping section is formed, and welding the end portion of the crimping section in the width direction after the depressing such that a welded portion is formed in the end portion of the crimping section.

7. A method of manufacturing a crimp terminal comprising: a separation step in which the terminal fitting is separated from the carrier, the separation step being performed after the method of manufacturing a terminal connection strip according to claim 6.

* * * * *